US008537063B2

(12) United States Patent
Lindenmeier et al.

(10) Patent No.: US 8,537,063 B2
(45) **Date of Patent: *Sep. 17, 2013**

(54) ANTENNA FOR RECEPTION OF SATELLITE RADIO SIGNALS EMITTED CIRCULARLY, IN A DIRECTION OF ROTATION OF THE POLARIZATION

(75) Inventors: Stefan Lindenmeier, Gauting (DE); Heinz Lindenmeier, Planegg (DE); Jochen Hopf, Haar (DE); Leopold Reiter, Gilching (DE)

(73) Assignee: Delphi Delco Electronics Europe GmbH (DE)

( * ) Notice: Subject to any disclaimer, the term of this patent is extended or adjusted under 35 U.S.C. 154(b) by 618 days.

This patent is subject to a terminal disclaimer.

(21) Appl. No.: 12/716,318

(22) Filed: Mar. 3, 2010

(65) Prior Publication Data

US 2010/0253587 A1 Oct. 7, 2010

(30) Foreign Application Priority Data

Mar. 3, 2009 (DE) ..... 10 2009 011 542

(51) Int. Cl.
*H01Q 21/00* (2006.01)

(52) U.S. Cl.
USPC ..... 343/728; 343/741; 343/743; 343/748; 343/866

(58) Field of Classification Search
USPC ..... 343/725, 726, 727, 728, 741, 742, 343/866, 867, 743, 748
See application file for complete search history.

(56) References Cited

U.S. PATENT DOCUMENTS

| | | | |
|---|---|---|---|
| 2,217,911 | A | 10/1940 | Lindenblad |
| 2,460,260 | A | 1/1949 | Kibler |
| 3,942,119 | A | 3/1976 | Meinke et al. |
| 4,070,677 | A | 1/1978 | Meinke et al. |

(Continued)

FOREIGN PATENT DOCUMENTS

| | | |
|---|---|---|
| DE | 1945850 | 3/1970 |
| DE | 2907369 | 8/1980 |

(Continued)

OTHER PUBLICATIONS

Johnston, R. H., et al.: "A compact three way diversity with low near back fields" Antennas and Propagation Society Internation Symposium, 1997. IEEE., 1997 Digest Montreal, Que., Canada Jul. 13-18, 1997, New York, NY, USA, IEEE, US LNKD-DOI:10.1109/APS.1997.631826, Bd. 2, Jul. 13, 1997, Seiten 1364-1367, XPO10247076 ISBN: 978-0-7803-4178-4.

(Continued)

*Primary Examiner* — Dieu H Duong
(74) *Attorney, Agent, or Firm* — J. Gordon Lewis

(57) ABSTRACT

An antenna for reception of satellite radio signals emitted circularly in the direction of rotation of polarization has a conductive base surface, an antenna connection point, an antenna element connection point and at least two antenna elements. The first antenna is a conductor loop disposed parallel to the base surface. The loop antenna has capacitors disposed along the conductor loop. The antenna connection point is coupled to an interruption of the loop antenna. This connection point feeds a ring current into the loop antenna. At least one additional antenna element extends between the antenna element connection point and the loop antenna. The additional antenna element has a polarization orientated perpendicular to the polarization of the loop antenna and an orthogonal phase in the far field.

36 Claims, 27 Drawing Sheets

(56) References Cited

U.S. PATENT DOCUMENTS

| | | | |
|---|---|---|---|
| 4,083,051 | A | 4/1978 | Woodward |
| 4,095,228 | A | 6/1978 | Meinke et al. |
| 4,602,260 | A | 7/1986 | Lindenmeier et al. |
| 4,752,968 | A | 6/1988 | Lindenmeier et al. |
| 4,791,426 | A | 12/1988 | Lindenmeier et al. |
| 4,914,446 | A | 4/1990 | Lindenmeier et al. |
| 5,029,308 | A | 7/1991 | Lindenmeier et al. |
| 5,049,892 | A | 9/1991 | Lindenmeier et al. |
| 5,097,270 | A | 3/1992 | Lindenmeier et al. |
| 5,138,330 | A | 8/1992 | Lindenmeier et al. |
| 5,266,960 | A | 11/1993 | Lindenmeier et al. |
| 5,289,197 | A | 2/1994 | Lindenmeier et al. |
| 5,313,660 | A | 5/1994 | Lindenmeier et al. |
| 5,589,839 | A | 12/1996 | Lindenmeier et al. |
| 5,619,214 | A | 4/1997 | Lindenmeier et al. |
| 5,751,252 | A | 5/1998 | Phillips |
| 5,801,663 | A | 9/1998 | Lindenmeier et al. |
| 5,818,394 | A | 10/1998 | Aminzadeh et al. |
| 5,826,179 | A | 10/1998 | Lindenmeier et al. |
| 5,850,198 | A | 12/1998 | Lindenmeier et al. |
| 5,905,469 | A | 5/1999 | Lindenmeier et al. |
| 5,926,141 | A | 7/1999 | Lindenmeier et al. |
| 5,929,812 | A | 7/1999 | Aminzadeh |
| 5,949,498 | A | 9/1999 | Rudolph |
| 5,973,648 | A | 10/1999 | Lindenmeier et al. |
| 6,011,962 | A | 1/2000 | Lindenmeier et al. |
| 6,123,550 | A | 9/2000 | Burkert et al. |
| 6,130,645 | A | 10/2000 | Lindenmeier et al. |
| 6,140,969 | A | 10/2000 | Lindenmeier et al. |
| 6,169,888 | B1 | 1/2001 | Lindenmeier et al. |
| 6,184,837 | B1 | 2/2001 | Lindenmeier et al. |
| 6,188,447 | B1 | 2/2001 | Rudolph et al. |
| 6,218,997 | B1 | 4/2001 | Lindenmeier et al. |
| 6,236,372 | B1 | 5/2001 | Lindenmeier et al. |
| 6,262,690 | B1 | 7/2001 | Malone et al. |
| 6,313,799 | B1 | 11/2001 | Thimm et al. |
| 6,317,096 | B1 | 11/2001 | Daginnus et al. |
| 6,377,221 | B1 | 4/2002 | Lindenmeier et al. |
| 6,400,334 | B1 | 6/2002 | Lindenmeier et al. |
| 6,421,532 | B1 | 7/2002 | Lindenmeier et al. |
| 6,430,404 | B1 | 8/2002 | Lindenmeier et al. |
| 6,574,460 | B1 | 6/2003 | Lindenmeier et al. |
| 6,603,434 | B2 | 8/2003 | Lindenmeier et al. |
| 6,603,435 | B2 | 8/2003 | Lindenmeier et al. |
| 6,611,677 | B1 | 8/2003 | Lindenmeier et al. |
| 6,618,016 | B1 | 9/2003 | Hannan et al. |
| 6,633,258 | B2 | 10/2003 | Lindenmeier et al. |
| 6,653,982 | B2 | 11/2003 | Lindenmeier et al. |
| 6,690,924 | B1 | 2/2004 | Jan et al. |
| 6,768,457 | B2 | 7/2004 | Lindenmeier |
| 6,888,508 | B2 | 5/2005 | Lindenmeier |
| 6,911,946 | B2 | 6/2005 | Lindenmeier |
| 6,917,340 | B2 | 7/2005 | Lindenmeier |
| 6,925,293 | B2 | 8/2005 | Lindenmeier et al. |
| 6,927,735 | B2 | 8/2005 | Lindenmeier et al. |
| 6,956,533 | B2 | 10/2005 | Lindenmeier |
| 6,960,984 | B1 | 11/2005 | Vicci et al. |
| 7,127,218 | B2 | 10/2006 | Lindenmeier |
| 7,403,167 | B2 | 7/2008 | Probst et al. |
| 7,555,277 | B2 | 6/2009 | Lindenmeier et al. |
| 7,564,416 | B2 | 7/2009 | Lindenmeier et al. |
| 7,702,051 | B2 | 4/2010 | Lindenmeier et al. |
| 7,936,309 | B2 * | 5/2011 | Lindenmeier et al. ..... 343/725 |
| 2001/0016478 | A1 | 8/2001 | Lindenmeier et al. |
| 2002/0118138 | A1 | 8/2002 | Lindenmeier et al. |
| 2002/0126055 | A1 | 9/2002 | Lindenmeier et al. |
| 2002/0154059 | A1 | 10/2002 | Lindenmeier et al. |
| 2002/0171600 | A1 | 11/2002 | Lindenmeier et al. |
| 2002/0196183 | A1 | 12/2002 | Lindenmeier |
| 2003/0164802 | A1 | 9/2003 | Lindenmeier |
| 2003/0210193 | A1 | 11/2003 | Rossman et al. |
| 2004/0113854 | A1 | 6/2004 | Lindenmeier |
| 2004/0160373 | A1 | 8/2004 | Lindenmeier |
| 2004/0164912 | A1 | 8/2004 | Lindenmeier et al. |
| 2004/0183737 | A1 | 9/2004 | Lindenmeier |
| 2004/0198274 | A1 | 10/2004 | Lindenmeier |
| 2006/0082494 | A1 | 4/2006 | Deininger et al. |
| 2006/0114146 | A1 | 6/2006 | Lindenmeier et al. |
| 2006/0182201 | A1 | 8/2006 | Lindenmeier et al. |
| 2007/0058761 | A1 | 3/2007 | Lindenmeier |
| 2007/0140389 | A1 | 6/2007 | Lindenmeier et al. |
| 2008/0018547 | A1 | 1/2008 | Iwasaki |
| 2008/0218422 | A1 | 9/2008 | Lindenmeier et al. |
| 2008/0248770 | A1 | 10/2008 | Schutz et al. |
| 2008/0260079 | A1 | 10/2008 | Lindenmeier et al. |
| 2009/0036074 | A1 | 2/2009 | Lindenmeier et al. |
| 2009/0042529 | A1 | 2/2009 | Lindenmeier et al. |
| 2009/0073072 | A1 | 3/2009 | Lindenmeier et al. |
| 2010/0066618 | A1 | 3/2010 | Heuer |

FOREIGN PATENT DOCUMENTS

| | | |
|---|---|---|
| DE | 4008505 | 9/1991 |
| DE | 10163793 | 9/2002 |
| EP | 1239543 | 9/2002 |
| EP | 1445832 | 8/2004 |
| EP | 2034557 | 3/2009 |
| GB | 675164 | 7/1952 |
| JP | 57063941 | 4/1982 |
| JP | 2000077934 | 3/2000 |
| WO | 01/43255 | 6/2001 |
| WO | 2007/011191 | 1/2007 |

OTHER PUBLICATIONS

U.S. Appl. No. 12/689,969, filed Jan. 19, 2010.
U.S. Appl. No. 12/786,236, filed May 24, 2010.

* cited by examiner

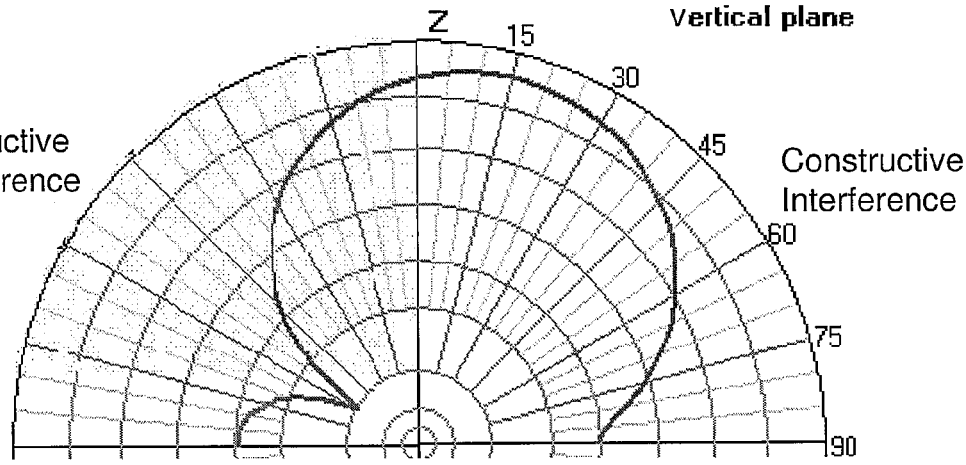
FIG. 16A
(a)
Horizontal diagram
FIG. 16B
(b)
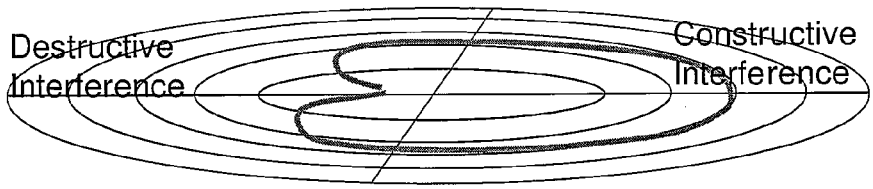

ANTENNA FOR RECEPTION OF SATELLITE RADIO SIGNALS EMITTED CIRCULARLY, IN A DIRECTION OF ROTATION OF THE POLARIZATION

CROSS REFERENCE TO RELATED APPLICATIONS

This application is a U.S. application and hereby claims priority from German application Serial No. 10 2009 011 542.0 filed on Mar. 3, 2009 the disclosure of which is hereby incorporated herein by reference in its entirety.

One embodiment of the invention relates to an antenna for reception of satellite radio signals emitted circularly, in a direction of rotation of the polarization.

With satellite radio signals, efficiency is important, both with regard to the transmission output emitted by the satellite and with regard to the efficiency of the reception antenna. Satellite radio signals are generally transmitted with circularly polarized electromagnetic waves, because of polarization rotations on the transmission path. In many cases, program contents, for example, are transmitted in frequency bands that lie very close to one another, in terms of frequency, as shown in FIG. 1. Using the example of SDARS satellite radio, this happens at a frequency of about 2.33 GHz, in two adjacent frequency bands each having a bandwidth of 4 MHz with a distance between the center frequencies of 8 MHz. The signals are emitted by different satellites, with an electromagnetic wave that is circularly polarized in one direction. Accordingly, for reception, antennas circularly polarized in the corresponding direction of rotation are used. Such antennas are known, for example, from DE-A-4008505 and DE-A-10163793. This satellite radio system is additionally supported by the transmission of terrestrial signals, in certain regions, in another frequency band having the same bandwidth, disposed between the two satellite signals. Similar satellite radio systems are currently in the planning stage.

The antenna known from DE-A-4008505 is built up on a conductive base surface oriented essentially horizontally, and consists of crossed horizontal dipoles having dipole halves inclined downward in V shape and consisting of linear conductor parts, which halves are fixed in place mechanically, relative to one another, at an azimuthal angle of 90 degrees, and are attached at the upper end of a linear vertical conductor attached to the conductive base surface. The antenna known from DE-A-10163793 as well as U.S. Pat. No. 6,653,982 wherein this antenna is also built up above a conductive base surface that is generally oriented horizontally, and consists of crossed frame structures mounted azimuthally at 90 degrees relative to one another. In the case of both antennas, the antenna parts that are spatially offset by 90 degrees relative to one another, in order to produce the circular polarization, are interconnected offset by 90 degrees relative to one another in the electrical phase.

For example FIG. 1A discloses a flat antenna for mobile satellite communications with circular polarization. Here, two antennas whose planes 0 are orthogonal to one another are combined in a particularly advantageous embodiment, wherein each antenna, has an asymmetrizing network 9 and a matching circuit 17. At the output of matching circuit 17, the voltage $U_z$ for circular polarization is formed by means of a phase-rotation element 18, and a summation circuit 19. The latter, as shown in FIG. 1A, are constructed by connecting in parallel, lines whose lengths differ by $\lambda/4$. This antenna also includes an antenna collection point 11, an impedence or capacitor 7, a vertical symmetry axis 8, and a conductor portion 16.

Both forms of antennas are particularly suited for reception of satellite signals, which are emitted by high-flying satellites—so-called HEOS. However, the signals of geostationary satellites—of so-called GEOS—come in at a lower elevation angle in the regions at a distance from the equatorial zones. The reception of such signals is possible only with a comparatively small antenna gain, in the case of the two antenna forms mentioned, and therefore is problematical, because of the weak transmitter power of the satellites—which results from economic considerations. In addition, there is the difficulty of structuring the antennas to have a small construction height, which is necessarily required, particularly for mobile applications. Patch antennas are known as other antennas of this type, according to the state of the art, but these are also less efficient with regard to reception at a low elevation angle.

One embodiment of the invention is configured to indicate an antenna having a low construction height, which is particularly suitable also for efficient reception of satellite signals emitted in circularly polarized manner in a direction of rotation, which signals come in at low elevation angles.

This task is accomplished, in the case of an antenna according to the preamble of the main claim, by means of the characterizing characteristics of the main claim and the measures proposed in the other claims.

Furthermore, an antenna of this type can advantageously be combined, in a common construction space, with antenna structures that also receive a circularly polarized field, and can be used, together with these antenna structures, in an antenna diversity system or a system for digital beam shaping with azimuthal beam scanning. This combination is particularly interesting also for reception systems in which signals from GEO satellites and HEO satellites are supposed to be received in the same manner in closely adjacent frequency bands. In this connection, the antenna combination is characterized by a particularly low reciprocal coupling of the antennas with one another.

SUMMARY

According to one embodiment, the antenna for reception of circularly polarized satellite radio signals comprises at least two antenna elements connected with an antenna connector, which antenna elements are linearly polarized in a spatial direction, in each instance, and are connected by way of an matching and phase shifter network wherein one of the antenna elements is formed as a loop antenna, essentially disposed in a horizontal plane. The loop antenna for its electrically effective shortening, has at least one interruption bridged by a capacitor. The loop antenna can have multiple interruptions disposed at a distance from one another and bridged by capacitors. At least one interruption of the conductor loop forms a loop antenna connection point of the loop antenna. Furthermore, at least one additional antenna element is present, which demonstrates linear polarization and is connected with its antenna element connection point as well as with the loop antenna connection point, by way of an matching and phase shifter network, which network is configured so that with reciprocal operation of the antenna as a transmission antenna, the radiation fields of the loop antenna and of the at least one additional antenna element are superimposed with different phases in the far field of the antenna. This at least one additional antenna element can have a polarization oriented perpendicular to the polarization of the loop antenna. All the antenna elements can be essentially formed from thin, wire-shaped conductors of similar conductor structures.

For the production of antennas that are known from DE-A-4008505 and DE-A-10163793 (also published as U.S. Pat. No. 6,653,982 to Lindenmeier) the individual antenna parts are placed on planes that intersect at a right angle, and that these planes additionally stand perpendicular on the conductive base plane. This particularly holds true for the frequencies of several gigahertz that are usual for satellite antennas, for which particularly great mechanical precision is necessary in mass production of the antennas, in the interests of polarization purity, impedance matching, and reproducibility of the directional diagram. The production tolerances that are required for antennas according to one embodiment of the present invention can be adhered to significantly more easily, in advantageous manner. Another very significant advantage of at least one embodiment results from the property that in addition to the horizontally polarized loop antenna, at least one additional antenna element is present, which has a polarization oriented perpendicular to the polarization of the loop antenna. This antenna element can advantageously be used, when terrestrial, vertically polarized transmission signals are present, also for reception of these signals.

The distribution of the currents on an antenna in reception operation is dependent on the terminating resistance at the antenna connection point. In contrast to this, in transmission operation, the distribution of the currents over the antenna conductors, with reference to the feed current at the antenna connection location, is independent of the source resistance of the feeding signal source, and is therefore clearly linked with the directional diagram and the polarization of the antenna. Because of this clear situation in combination with the law of reciprocity, according to which the radiation properties—such as directional diagram and polarization—are identical in transmission operation and in reception operation, the task according to at least one embodiment of the present invention, with regard to polarization and radiation diagrams, is accomplished on the basis of the configuration of the antenna structure to produce corresponding currents in transmission operation of the antenna. In this way, the task according to at least one embodiment of the present invention is also accomplished for reception operation. All the considerations below, concerning currents on the antenna structure and their phase reference point, therefore relate to reciprocal operation of the reception antenna as a transmission antenna, unless reception operation is specifically addressed.

BRIEF DESCRIPTION OF THE DRAWINGS

In the following, the invention will be explained in greater detail using exemplary embodiments. The related figures show, in detail:

FIG. 16A discloses a vertical directional characteristic of the LHCP-polarized electromagnetic field of an antenna for 2.3 GHz, corresponding to FIG. 18;

FIG. 16B discloses horizontal directional characteristic of the LHCP-polarized electromagnetic field at an elevation angle of about 30 degrees with minimal radiation for the azimuthal angle of 180 degrees;

DETAILED DESCRIPTION

One embodiment is directed to a reception antenna, wherein the following properties of the antenna will be described for reciprocal operation of the antenna as a transmission antenna, for reasons of better reproducibility, whereby the transmission case, however, applies also for the directional diagrams of the reception case, because of the reciprocity relationship that of course applies.

In the following, the fundamentals concerning configuration of antennas, on which the antenna according to the invention is based, are explained.

Figure 1A:
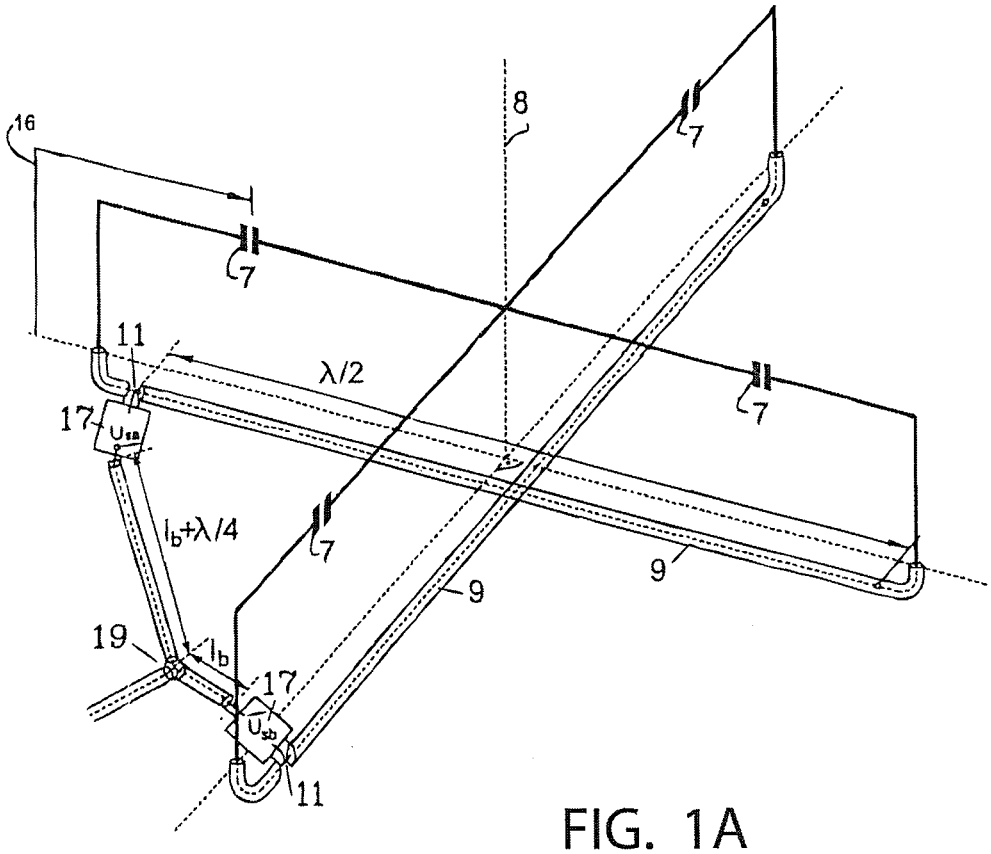
FIG. 1A shows a prior art FIG. relating to a flat antenna for mobile satellite communications.
Figure 1B:
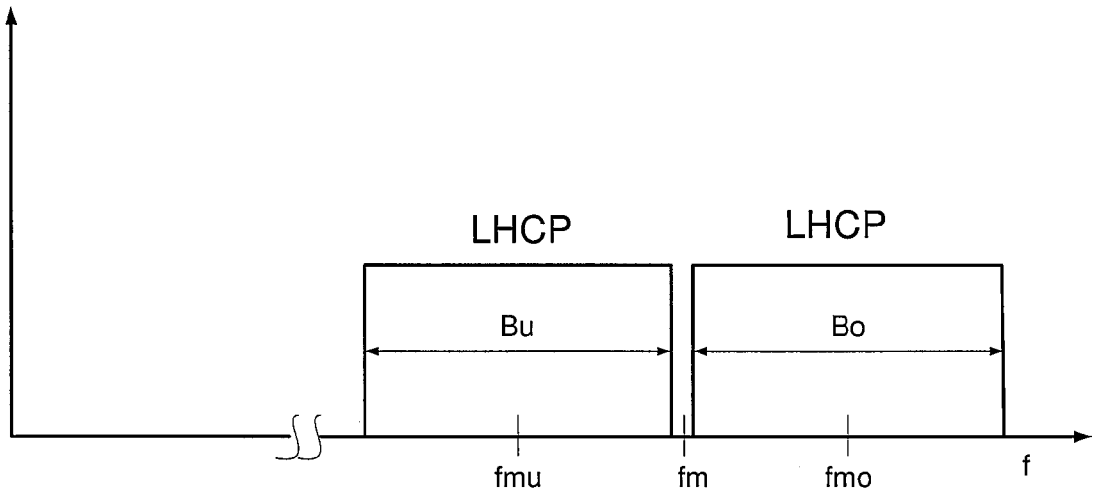
FIG. 1B shows a graph of frequency bands of two satellite radio signals with circularly polarized radiation, in the same direction of rotation, in close frequency proximity.

Turning in detail to the drawings, FIG. 1B shows for example a graph of frequency bands of two satellite radio signals with circularly polarized radiation, in the same direction of rotation, in close frequency proximity. These two bands are LHCP bands designated with the first band having a center frequency at fmu and the second band having a center frequency at fmo.

Figure 2:
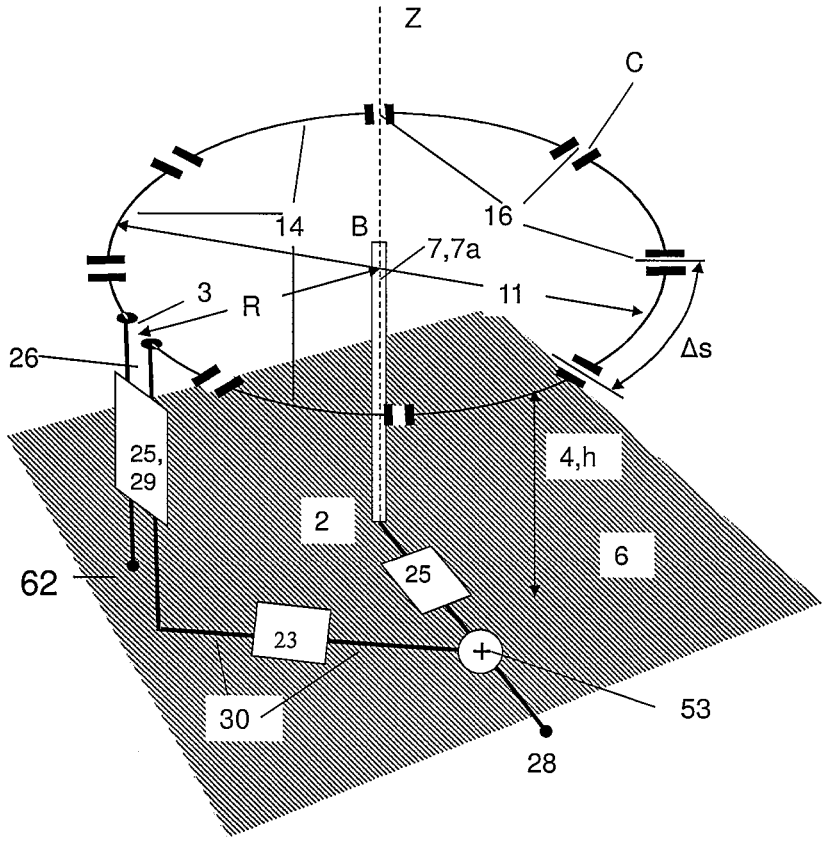
FIG. 2 discloses a schematic perspective view of a first embodiment of an antenna.

The particular advantage of an antenna according to the embodiment as shown, for example, in FIG. 2, is the property that the electrical field intensity vector produced in the far field during operation of the antenna as a transmission antenna, in accordance with the reciprocity law, also describes a substantially pure, in the technical sense, circular polarization with an azimuthal all-around characteristic even at relatively low elevation angles of the radiation. FIG. 2 shows a schematic perspective view of a first embodiment of an antenna a loop antenna 14 over the conductive base surface 6, with horizontal polarization and with a monopole 7*a* configured as a rod antenna as an additional antenna element 7 in the center axis Z of the horizontal loop antenna 14. The additional antenna element 7 for reception of vertically polarized fields. The antenna has a matching network 25 and phase shifter network 23 for phase-differential superimposition of the reception of the horizontally and vertically polarized field components in a summation network 53.

With a phase-rigid combination of the horizontally polarized loop antenna 14 with the at least one vertical antenna element 7, there is superimposition of the remote radiation fields of the two antenna elements by 90 degrees, by means of correspondingly different phase feed and corresponding amplitude feed of the two antennas. With this, two field intensity vectors are produced in the remote radiation field, in a plane perpendicular to the propagation direction, which vectors stand perpendicular on one another and differ by 90 degrees in phase, and represent the desired circularly polarized field. For the production of the all-around characteristic, it is required that the phase reference points B—also called phase emphasis points—of the two antennas coincide, and this is achieved by means of a rotation-symmetrical placement about the common center axis Z of the antennas.

Antenna 14 can be a circular or polygonal loop antenna 14 disposed above the base surface 6 in a plane having a constant distance 4 as a height h. This antenna acts essentially similar to a frame antenna over a conductive surface. With the prerequisite of an azimuthally constant current application to the loop antenna 14, the elevation angle of the main radiation direction can be adjusted by way of the selection of the height h and the horizontal expanse—this means the radius in the case of a circular configuration of the loop antenna 14. In this connection, a zero position in the vertical direction and in the horizontal direction can be achieved. Achieving a desired vertical directional diagram, however, requires a horizontal expanse of the loop antenna in such a manner that its total circumferential length is no longer small in comparison with the electrical free space wavelength $\lambda_0$. According to this embodiment of the invention, the loop antenna is therefore divided into n equal line sections having the length $\Delta s<\lambda_0/8$, by means of interruption points 5, which are connected with one another, in each instance, by means of insertion of a capacitor such as capacitor 16. In this connection, the capacitors are preferably selected so that together with the properties of the line sections, resonance occurs at the operating frequency fm. Such an antenna can advantageously be configured for an azimuthally substantially pure omnidirectional characteristic. In combination with the at least one vertical antenna element 7, which is present in the center Z of the loop antenna 14 in the example of FIG. 2, and whose azimuthal radiation diagram is also omnidirectional, the desired circularly polarized radiation field with a substantially pure all-around characteristic is also obtained for the antenna of FIG. 2. Thus, this type of antenna is advantageously suitable particularly for satellite radio reception in vehicles, where antennas having an azimuthal all-around characteristic are applied to the electrically conductive external skin of the vehicle.

FIG. 2 shows a circular loop antenna 14 having a radius R, which antenna can also be configured to be polygonal. Its phase reference point B is located at its center point, at the center axis Z. The structure is subdivided into "n" line sections, each having the length Δs. The total circumference length is S. The antenna acts as a frame antenna having dimensions in the range of the wavelength, whereby nevertheless, according to the invention, a homogeneous current distribution is achieved by means of subdivision of the structure and insertion of capacitors 16. As a result, the antenna acts electrically shortened in length, and produces a homogeneous, horizontally polarized electromagnetic field all around. The loop antenna 14 is disposed at a constant height h above the conductive base surface 6. The vertical main radiation direction can be set by way of the selection of the height h and the radius of the loop antenna 14. A zero position can be achieved in the vertical direction and in the horizontal direction.

The ring-shaped circumferential line length S is divided into n equally long pieces having a length $\Delta s=S/n$. Let the line wave resistance of the circumferential line above the conductive base surface 6 be Zw. The capacitative reactance ΔX per line piece Δs and thus the capacitance value $C=1*\Delta X$) to be inserted into this line piece, in each instance, is defined, assuming an extended length Δs and with an approximately ring-shaped line having a large radius R of the ring-shaped loop antenna 14 relative to the line height h, by $$\Delta X/Zw=\tan(2\pi\Delta s/\lambda_0).$$

The capacitance value C to be inserted into the line piece Δs is obtained in a good approximation:

$$C=1/(\omega Zw\tan(2\pi\Delta s/\lambda_0))$$

Circular frequency of the satellite signals=ω; free space wavelength of the satellite signals=$\lambda_0$ With this dimensioning of the capacitance values C, resonance can be set for the loop antenna 14, so that the antenna impedance that occurs at the loop antenna connection point 3 can be configured to be real, to a great extent.

To obtain an all-around diagram, in a good approximation, the line having the length S must be divided into sufficiently many partial pieces by inserting capacitors 16. For a reasonable division, the following applies: $\Delta s/\lambda_0<1/8$. If the partial pieces Δs=S/n are selected to be sufficiently small such as $\Delta s/\lambda_0<1/8$, then equality Δs of all the partial pieces is not absolutely necessary, as long as a capacitor 16 is inserted after every partial piece, the value of which capacitor is calculated according to the criterion described above, from the relative length $\Delta s/\lambda_0$ of the partial piece in question.

As an additional antenna element 7, in the example of FIG. 2, an electrically short, vertically oriented monopole 7*a* is affixed in the center Z of the loop antenna 14. The deviation of the positioning of the monopole 7*a* from the center Z should not exceed $\lambda_0/20$, in the interests of roundness of the radiation diagram. At an interruption point of the loop antenna 14, its loop antenna connection point 3 is formed, at which, by way of a two-wire line 26, an matching network 25 with balance-unbalance elements 29 and a subsequent phase shifter network 23 are connected. The antenna element connection point 2 of the monopole 7*a* follows the matching network 25 for impedance adjustment, and the signals of the monopole 7*a* and of the loop antenna are superimposed in the summation network 53; this, in turn, is connected with the antenna connection point 28. To produce the circularly polarized radiation, the phase of the phase shifter network 23 and all the networks, in their interaction, are set in such a manner that the radiation fields of the loop antenna 14 and those of the monopole 7*a* are superimposed, in the far field of the antenna, at a phase difference of 90 degrees and with the same intensity.

To avoid non-symmetries of the azimuthal directional diagram of the monopole 7*a*, brought about by the two-wire line 26, which runs essentially vertically, the latter is structured, according to the invention, so that it acts with an inductive high ohm effect, with regard to the longitudinal current that flows in common mode, which is superimposed on the current pair that flows on the two conductors in push-pull mode. In this way, the result is achieved that the two-wire line 26 does not influence the radiation field of the monopole 7*a*. A number of possibilities exists for the configuration of such a two-wire line 26. In practice, it can be produced in advantageous manner, for example, by means of a two-wire line printed onto a carrier, which line is configured as a meander, in order to increase its inductance. In addition, a desired phase relationship can be produced by means of the selection of its length.

By way of different weighting in the superimposition of the two antenna signals, the vertical directional diagram can be filled out in the direction of low elevation angles for these signals. The monopole 7*a*, configured as a rod antenna, possesses a similar main radiation direction, in its vertical directional characteristic, as the horizontally polarized loop antenna 14, but makes a bigger contribution than the latter for low elevation angles. Using the networks 25, 23, 53, not only can the weighting of the properties of the two antenna signals be set differently, but also the required phase condition can be met.

The influence of a symmetrical vertical feed line in the form of the symmetrical two-wire line 26 not situated in the center axis Z does not reduce the polarization purity of the loop antenna 14 itself. It is advantageous if the connection of the one connector on the non-symmetrical side of the matching and balance-unbalance element 25, 29 with the further circuit of the antenna array takes place using a microstrip conductor 30 passed over the conductive surface 6. The other connector on the non-symmetrical side of the balance-unbalance element 29 is connected with the electrically conductive base surface 6. Because of the symmetry properties of the two-wire line 26, the effects of the currents that flow in opposite directions on the conductors of the two-wire line 26 compensate one another to a sufficient degree, so that these also do not influence the radiation properties of the loop antenna 14. As will be explained in the following, the currents produced on these conductors by the electromagnetic reception field also have no influence on the effects at the antenna connection point 3. With regard to the azimuthal radiation diagram of the monopole 7*a*, however, residual non-symmetry can occur, as a function of the radius R of the loop antennas 14.

It corresponds to the nature of the present invention that both the axis relationship and the spatial orientation of the ellipsis for elliptical polarization can be set by means of setting the matching networks 25 and the phase shifter network 23. This settability can be utilized in very advantageous manner, according to the invention, for example, in antenna diversity technologies, to continuously optimize the reception power in the reception field distorted by multi-path propagation, by means of current matching of the ellipticity of the polarization.

Figure 15:
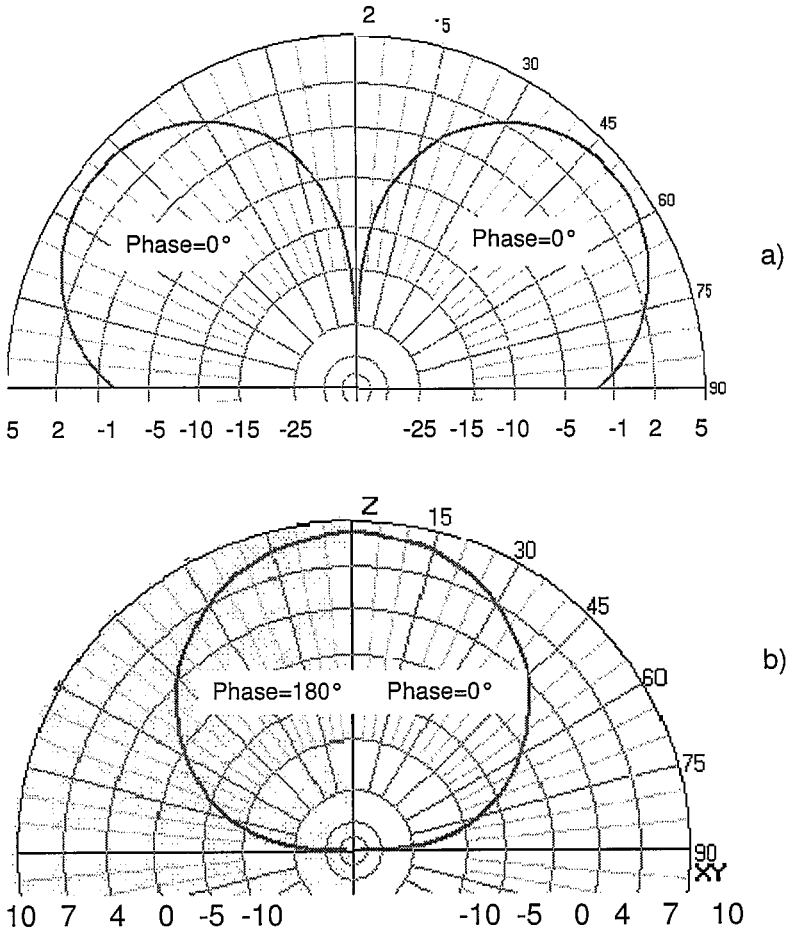
FIG. 15A discloses the Vertical directional characteristics of the LHCP-polarized electromagnetic field of an antenna as shown in FIG. 2, with circular polarization at low elevation angles and with azimuthal independence of the phase of the radiation.
FIG. 15B discloses the vertical direction characteristics of the LHCP polarized electromagnetic field of an antenna of FIG. 2 with a crossed antenna element according to the state of the art, or, respectively, of a ring line antenna element according to the invention as in FIG. 19, with circular polarization at high elevation angles; whereby the phase of the circular polarization turns with the azimuthal angle of the propagation vector.

As an example for the configuration of reception in the range of an elevation angle between 25 degrees and 65 degrees (typical angle range for GEO-stationary satellite reception) with an azimuthal all-around characteristic, a horizontally disposed loop antenna 14 is placed above the conductive base surface 6 at a distance of about 1/10 of the wavelength. It is advantageous if the diameter of the loop antenna 14 is selected to be not significantly smaller than 1/4 of the wavelength. Along the conductor path, at intervals of about 1/8 of the wavelength, an interruption point 5 equipped with a capacitor 16 having a reactive resistance of about −200 Ohm is inserted. Because of the effect of the capacitors 16 according to the invention, it is possible to achieve an azimuthally constant current distribution on the loop antenna 14, as required for all-around radiation, although the extended length of the loop antenna 14 is not short in comparison with the wavelength λ. On the other hand, this length is necessary in order to bring about a practicable impedance of the loop antenna 14. In FIG. 15(*a*), the vertical diagram of such an antenna according to this embodiment is shown as an example. For the example of a square-shaped loop antenna 14 with a central short vertical monopole, in the frequency range around 2.3 GHz, an edge length of about 3 cm and a height h of 13 mm have proven to be advantageous for the loop antenna 14, to implement both the vertical directional diagram according to FIG. 15(*a*) and a matching conductor wave resistance Zw.

Another property that should be emphasized as compared with the antennas known from the state of the art, such as, for example, those from DE-A-4008505 and DE-A-10163793 and which issued as U.S. Pat. No. 6,653,982 titled Flat Antenna for Mobile Satellite Communication, which issued on Nov. 25, 2003 and wherein the disclosure of which is hereby incorporated herein by reference. In contrast to this, the phase of the antennas mentioned above, according to the state of the art, changes with the azimuthal angle of the propagation vector, in other words by the angle $2\pi$ in the case of a complete azimuthal revolution. The significance of these properties, according to one embodiment of the invention, with regard to a combination of antennas according to the cited state of the art with an antenna according to one embodiment of the invention will be explained below.

For the case that the satellite radio system is additionally supported by means of transmission, in certain regions, of vertically polarized terrestrial signals, in another frequency band having a similar bandwidth, closely adjacent in frequency, it is desirable to fill up the vertical directional diagram for the vertical component of the electrical field intensity toward low elevation angles. The connection, according to the invention, of the loop antenna 14 and the additional antenna element 7, polarized vertical to it—implemented, in most cases, as a vertical monopole—makes it possible to take this aspect into consideration in particularly advantageous manner.

Figure 3:
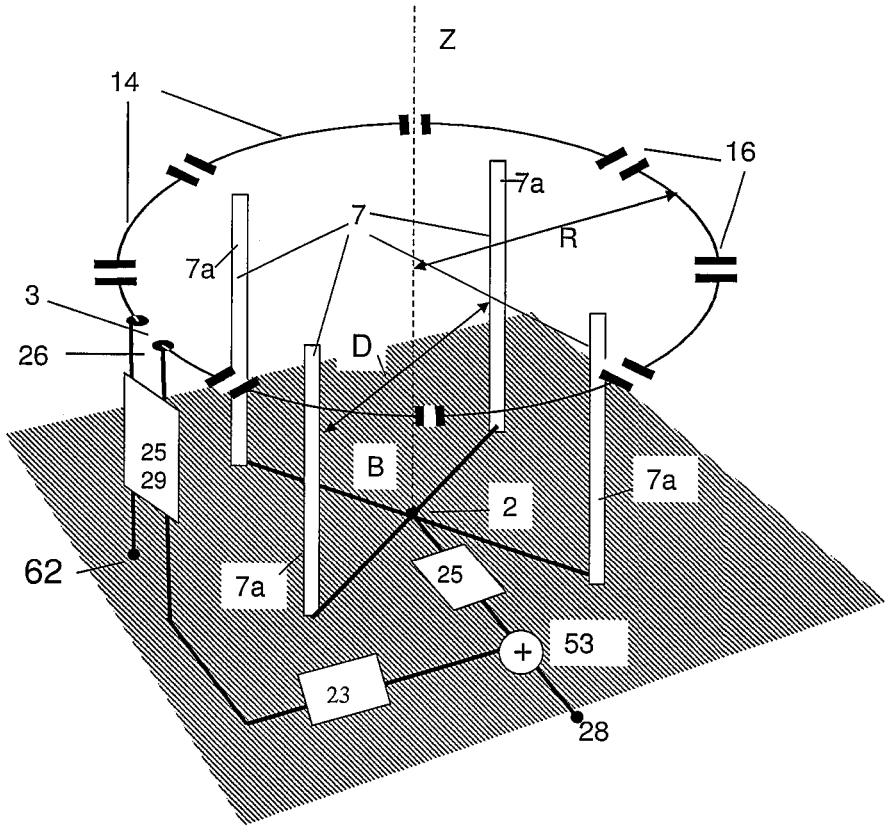
FIG. 3 discloses an antenna as in FIG. 2, but with a plurality of monopoles disposed with rotation symmetry relative to a center axis Z.

In FIG. 3 an antenna according to one embodiment of the invention is shown, whereby the additional antenna element 7, which is oriented perpendicular on the plane of the loop antenna 14, is formed from a group of monopoles 7*a*. These are disposed with rotation symmetry relative to the center Z and within the loop antenna 14. The monopoles are connected with one another at their lower end, by way of lines, at the center Z, and form the antenna element connection point 2 there. If the diameter of the circular ring on which the monopoles 7*a* are disposed around the center Z is not too great, and if the number of monopoles 7*a* is not too low, the azimuthal directional diagram of the antenna element 7 configured in this manner is sufficiently omnidirectional.

Figure 4:
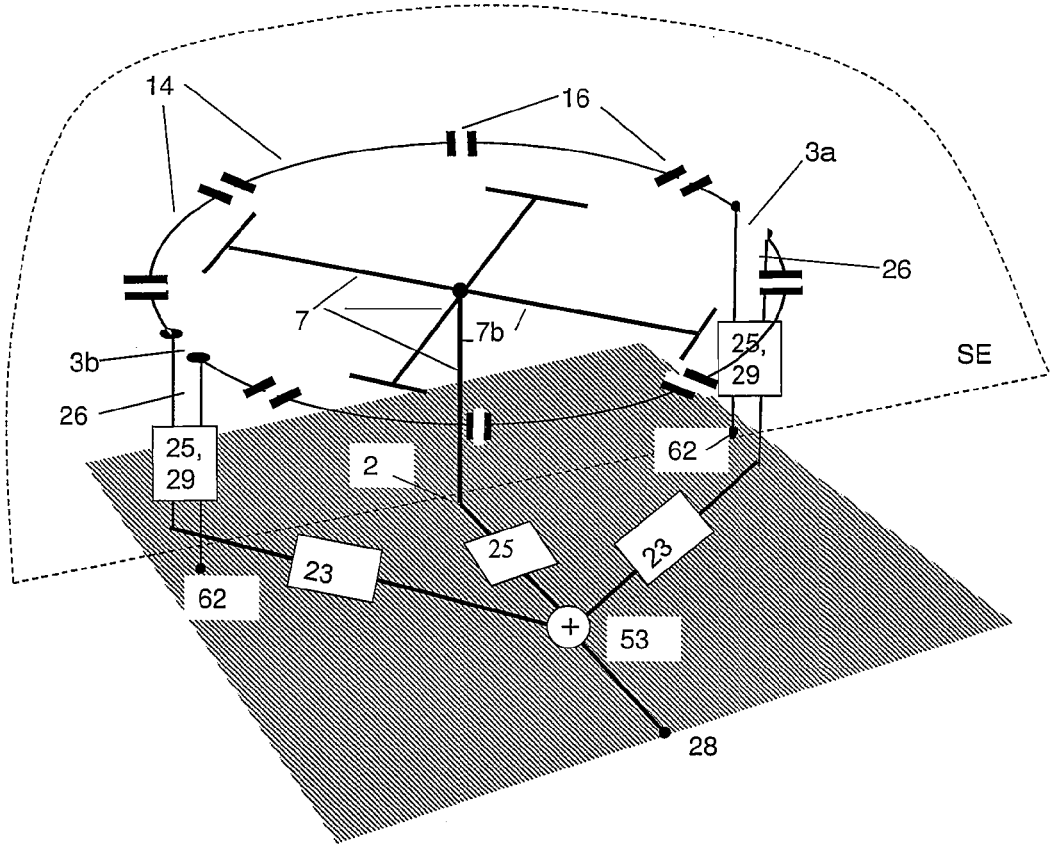
FIG. 4 discloses an antenna as in FIG. 2, but with a loop antenna with two antenna connection points formed to lie opposite one another.

FIG. 4 shows another embodiment of an antenna similar to FIG. 2, whereby the loop antenna 14 has two antenna connection points 3*a*, 3*b* that lie opposite one another in the plane of symmetry SE, in order to reduce the residual non-symmetry of the array with regard to the azimuthal directional diagram of the monopole 7, at which points the balance-unbalance- and matching networks 25, 29 disposed in the loop plane are connected. These outputs are switched in parallel by way of equal phase shifter networks 23 and connected with the two-wire line 26. The additional antenna element 7 disposed in the center axis Z is structured as a monopole 7*b* with horizontal conductor parts, disposed with rotation symmetry relative to the center axis Z, as a roof capacitor. These conductor parts are also structured to be symmetrical to the plane of symmetry SE.

Figure 5:
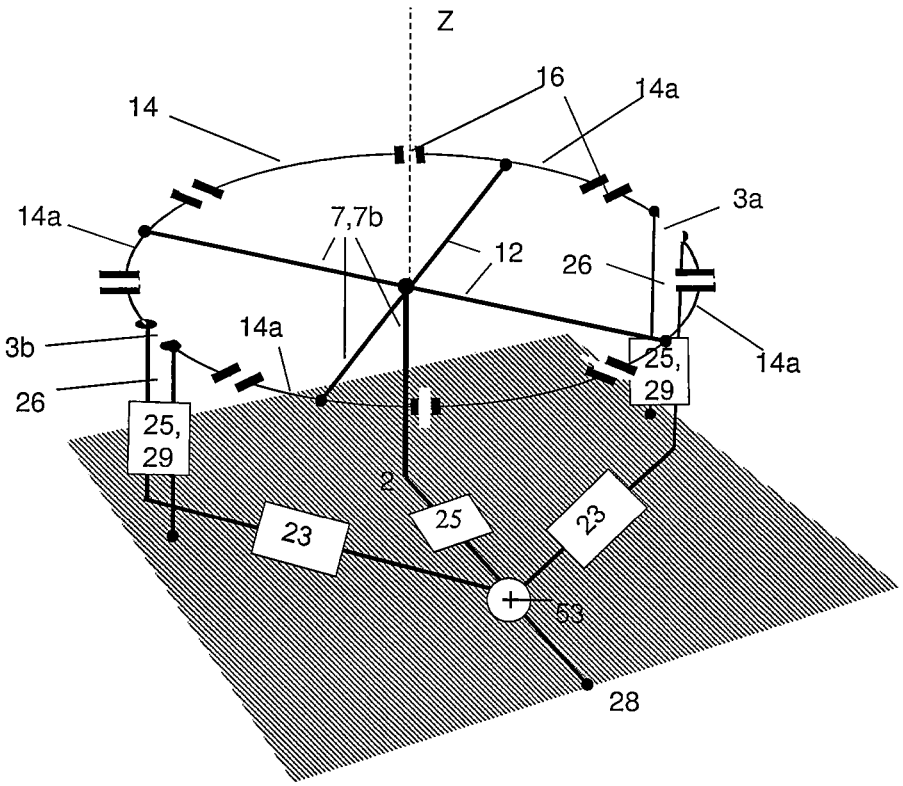
FIG. 5 discloses an antenna as in FIG. 4, whereby, however, conductor parts of the loop antenna have been used to form the rotation-symmetrical roof capacitor.

FIG. 5 shows another embodiment similar to FIG. 4, wherein the conductor parts of the loop antenna 14, however, is used to form the rotation-symmetrical roof capacitor 12. In the case of a completely symmetrical configuration of the roof capacitor 12 both with regard to rotation symmetry and also similar to the plane of symmetry SE shown in FIG. 4, the function of the loop antenna 14 is not impaired by the connector of the roof capacitor 12 of the monopole.

Figure 14:
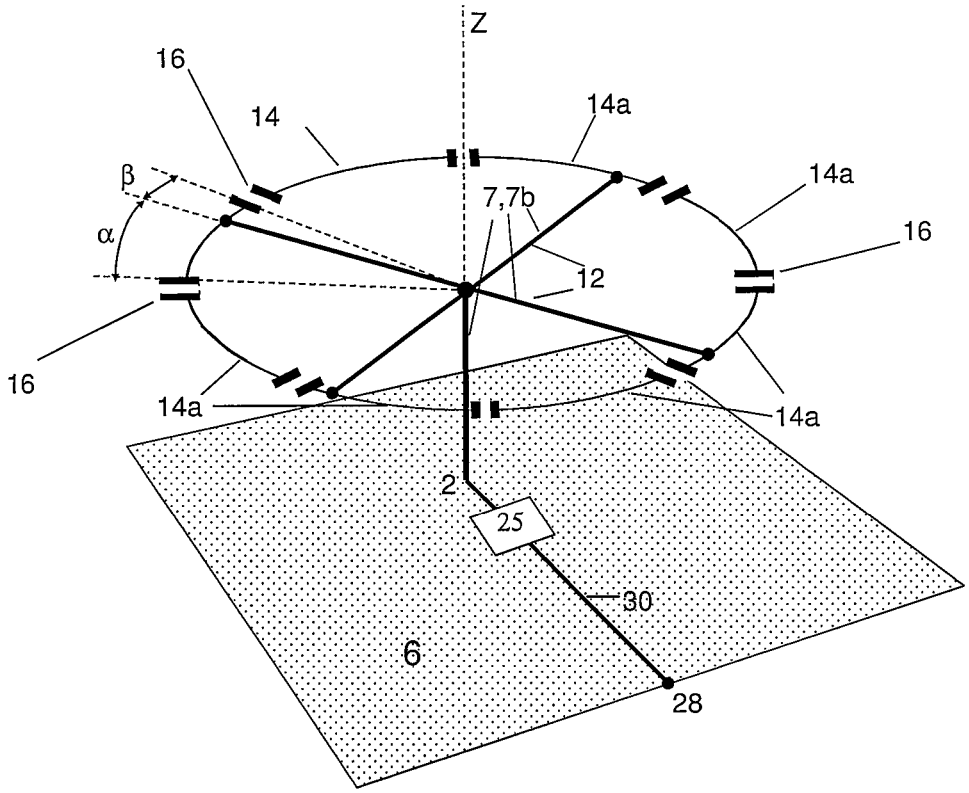
FIG. 14 discloses a design similar to that shown in FIG. 5, but with a common antenna element connection point for the common feed of the loop antenna and of the vertical monopole with roof capacitor.

In FIG. 14, an antenna according to the invention is shown as in FIG. 5, but with a common antenna element connection point 2 for common feed of the loop antenna 14 and of the vertical monopole with roof capacitor 7*b*. The circularly polarized field occurs in that the waves that arrive at the loop antenna 14 in transmission operation, by way of the vertical monopole antenna and by way of the horizontal arms of the roof capacitor 12, split up to right and left, whereby the distance to the nearest capacitor 16 on the loop antenna toward the right side is selected to be different from the distance to the nearest capacitor 16 on the loop antenna toward the left side. The loop antenna must therefore be rotated about the z axis, relative to the roof capacitor, in such a manner that different angle distances $\alpha$ and $\beta$ occur on the left side and the right side, between the horizontal arms of the roof capacitor and the next capacitor, in each instance. In this manner, a loop antenna connection point for feeding the ring current to the loop antenna 14 is formed, in interaction of the feeding horizontal arms of the roof capacitor 12 and the related interruptions of the conductor loop. In this connection, the horizontal arms of the roof capacitor 12 are fed by way of the antenna element connection point 2, not only for its effect as a roof capacitor, but furthermore also for production of the ring current on the loop antenna 14, so that feed of the loop antenna 14 and of the monopole 7*b* with roof capacitor can take place in efficient, very advantageous manner, by way of the common antenna element connection point 2 of the monopole 7*b*.

Figure 6:
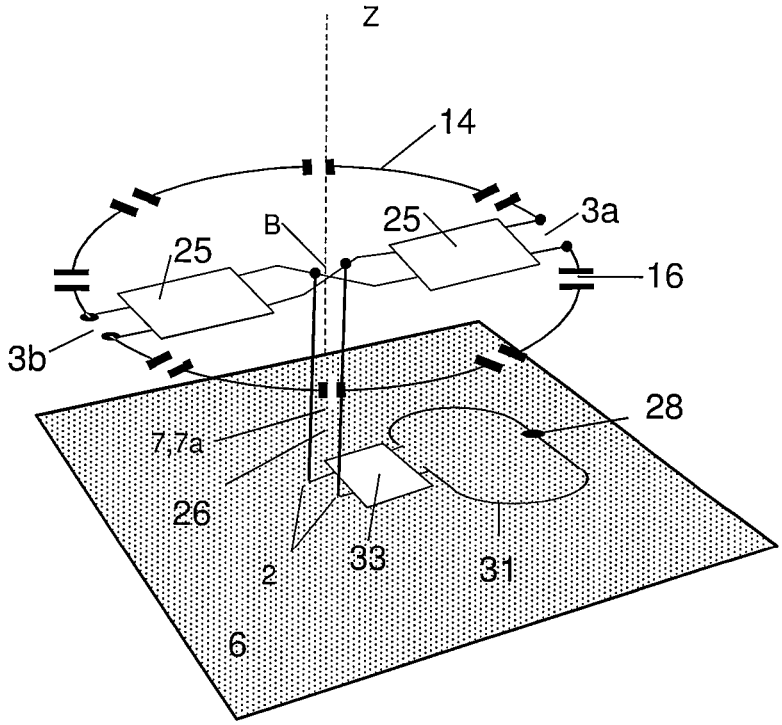
FIG. 6 discloses an antenna similar to FIG. 2, but with a vertical feed line to supply the loop antenna, whereby the feed line additionally forms a vertical monopole and the loop antenna forms a roof capacitor of the monopole.

FIG. 6 shows another advantageous embodiment of the invention according to the functional principle of the antenna in FIG. 2, but with a vertical feed line 26 disposed in the center Z, for feeding the loop antenna 14, whereby the feed line 26 forms a vertical monopole 7*a* and the loop antenna 14 forms a roof capacitor 12 of the monopole 7. The loop antenna 14 is formed with two antenna connection points 3*a*, 3*b* disposed symmetrically relative to one another, and an matching network 25 in the loop plane, in each instance, as well as with a central connection to the vertical feed line to the matching network 33, configured as a two-wire line 26. In this connection, the effects of the currents of the loop antenna 14 that flow in opposite directions on the conductors of the two-wire line 26, in push-pull mode, compensate one another. The reception voltage of the monopole 7*a* is passed to the power splitter and phase shifter network 31 at its antenna element connection point 2, as a common mode of the two-wire line 26, at one output, and the reception voltage of the loop antenna 14 is passed to this network as a push-pull mode of the two-wire line 26, at the other output of the matching network 33, for amplitude-appropriate and phase-differential superimposition of the signals at the antenna connector 28.

Figure 7:
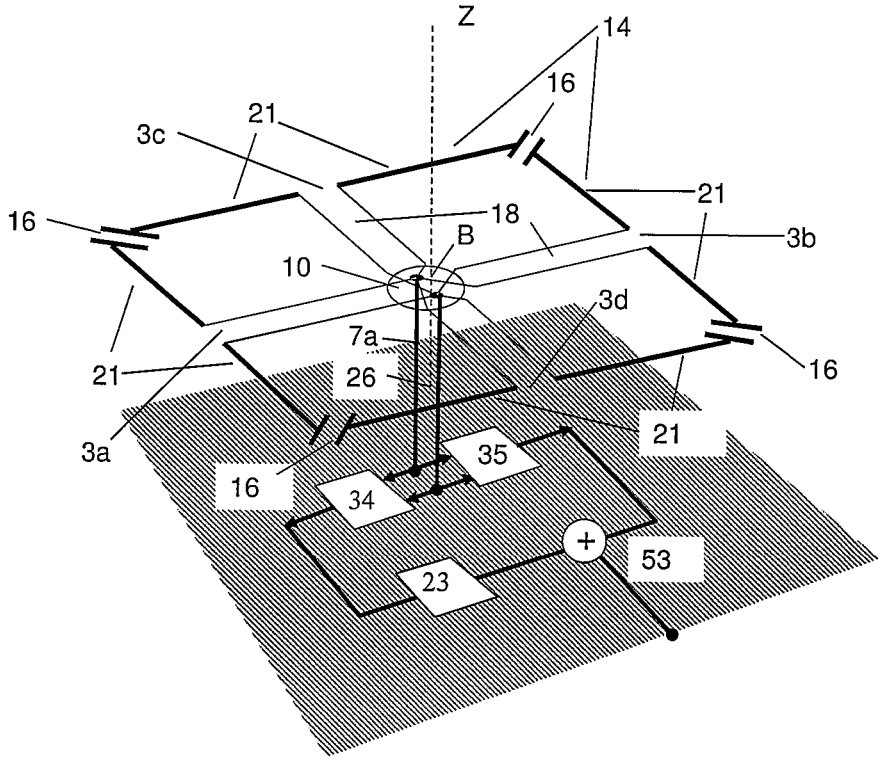
FIG. 7 discloses an antenna similar in design to that shown in FIG. 6, but with a loop antenna formed as a square, with the center Z.

FIG. 7 shows another advantageous embodiment of the antenna according to the functional principle of the antenna in FIG. 6, but with a loop antenna 14 configured as a square with the center Z, which antenna is formed by four dipoles 21 disposed in a square, which lie horizontally and are connected at their ends by way of capacitors 16, with a distribution network 10 disposed centrally in the phase reference point B and connected by way of feed lines 18. The dipole system acts as a roof capacitor of the vertical monopole formed in this manner, similar to that explained in FIG. 5. The reception of horizontal and/or vertical electrical field components takes place by way of sum formation 34 or difference formation 35, respectively, and phase-differential superimposition of the signals by way of the phase shifter network 23 and the summation network 53.

Figure 8:
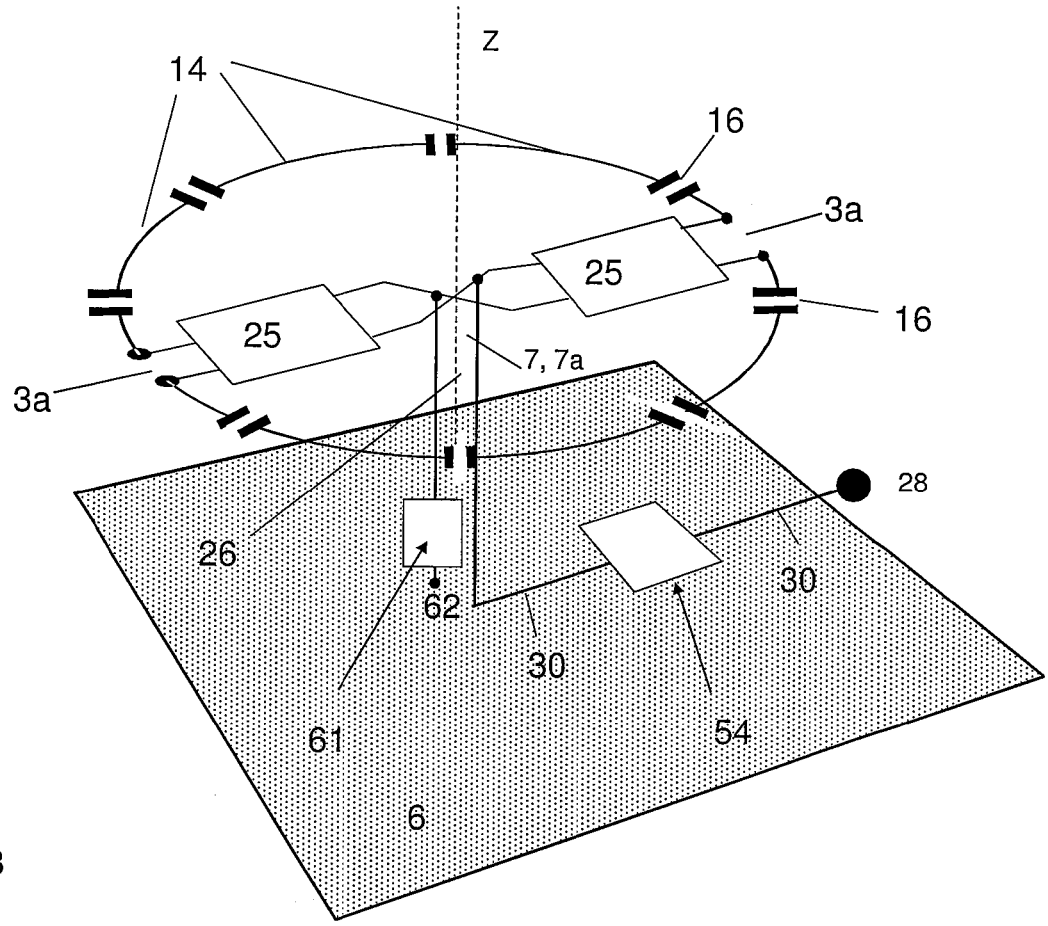
FIG. 8 discloses another embodiment of the invention with phase-differential superimposition of the reception voltages from the horizontal and the vertical electrical field components of a loop antenna and a monopole antenna formed by the vertical two-wire line.

In another advantageous embodiment of the invention, in FIG. 8, an antenna array is shown with phase-differential superimposition of the reception voltages from the horizontal and the vertical electrical field components of a loop antenna 14 and a monopole antenna 7*a* formed by the vertical two-wire line 26. Similar to FIG. 4, here again, two antenna connection points 3*a*, 3*b* with matching networks 25 are present in the plane of the loop antenna 14, which points lie opposite one another in the plane of symmetry SE, to improve the symmetry of the array. Using a dipole network 61 introduced into one of the conductors of the two-wire line 26, setting of the common mode to push-pull mode ratio takes place on the vertical two-wire line 26, thereby setting the ratio of the proportion of the vertically polarized field at low elevation of the main radiation direction to the proportion of the horizontally polarized field at higher elevation of the main radiation direction. In addition, the setting of the phases required for production of circular polarization takes place using this summation network 53. According to the invention, the axis relationship and the spatial orientation of the ellipsis for elliptical polarization can be set by means of the selection of the aforementioned common mode to push-pull mode ratio and the phase setting.

Figure 9:
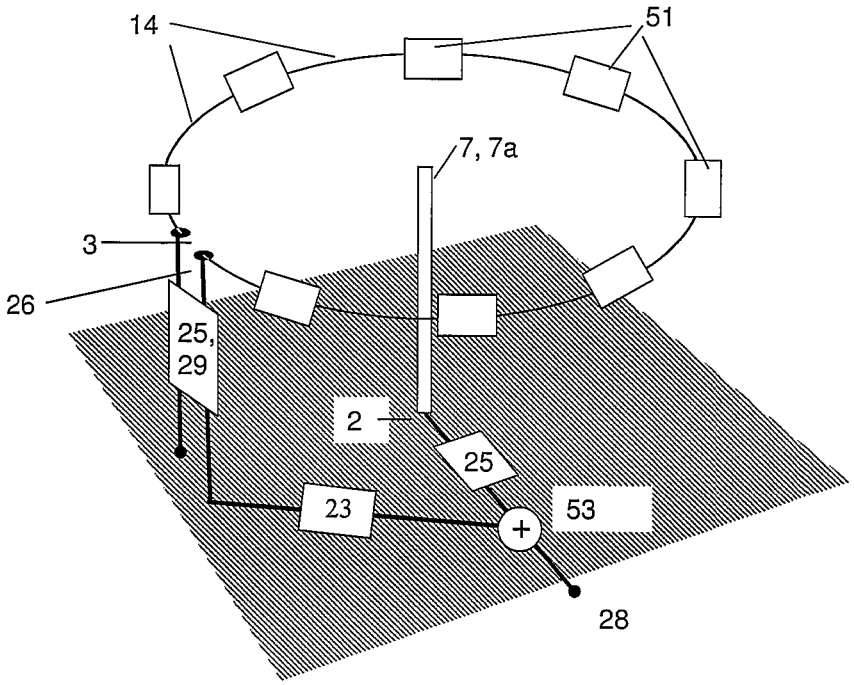
FIG. 9 discloses a design similar to that shown in FIG. 2, whereby in place of discrete capacitors, the capacitor, which is formed from a circuit of multiple reactive elements, in each instance, in such a manner that at different frequencies, different capacitance values are in effect.

In another advantageous embodiment of the invention in FIG. 9, the antenna—for example similar to the embodiment as in FIG. 2—is configured, however, as a multi-frequency range antenna. For this purpose, in place of discrete capacitors in the loop antenna 14, the capacitors 16 are formed, in each instance, from equal dipole networks, consisting of a circuit of multiple reactive elements, in each instance. In this way, different capacitance values are in effect at different operating frequencies, which values allow the resonance for configuring the real antenna impedance at these different operating frequencies.

Figure 10:
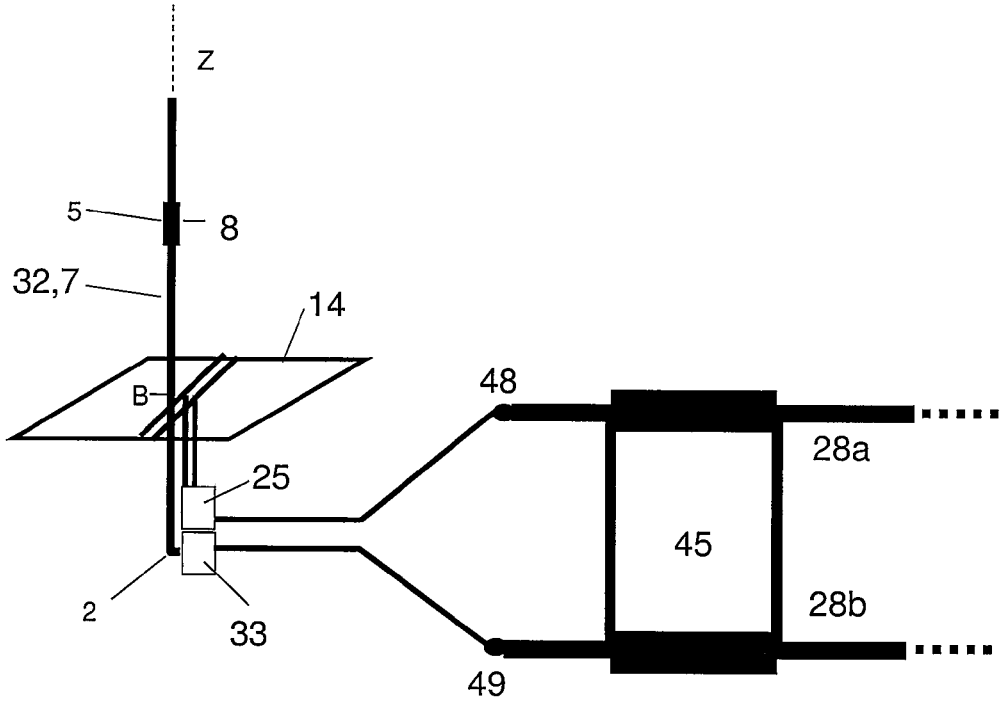
FIG. 10 discloses a combined antenna array of another embodiment for separate availability of LHCP signals and RHCP signals, respectively, of different satellite signals at different antenna connection points with a vertically polarized monopole configured as a rod antenna, a horizontally polarized loop antenna and a 90 degrees hybrid coupler.

In FIG. 1B, the situation is shown that two satellite radio frequency bands having a small bandwidth Bu and Bo (typically about 4-25 MHz), respectively, are emitted closely adjacent, at a high frequency in the L band and in the S band, respectively, in any case at a frequency of fm>1 GHz, with the same directions, in other words with left-rotating circular polarization (LHCP), for example. At a bandwidth Bu and Bo, respectively, of a few megahertz (typically about 4-25 MHz), the relative frequency interval between the center frequencies fmu and fmo is so slight that frequency-selective configuration of the antenna is not possible, and not necessary if the frequency bandwidth of the antenna is suitable. Both signals can therefore be received at the same antenna connection point 28, because of the sameness of the directions of rotation of the polarization. For the case that another satellite radio signal is present in the close frequency vicinity, having the other circular polarization, this can be configured by means of configuring two separate antenna connection points 28*a* and 28*b* within the scope of a combined antenna according to the invention. FIG. 10 shows an antenna array having a vertically polarized monopole 7 configured as a rod antenna, and a horizontally polarized loop antenna 14 according to the invention, with a common phase reference point B with regard to the transmission case, but with separate feed of the signals to the connector for vertical polarization 49 and to the connector for horizontal polarization 48, respectively. The hybrid coupler 45 with 90 degrees positive and negative phase difference with regard to the LCHP connector 28*a* and the RCHP connector 28*b*, respectively, which coupler follows these connectors, allows separate availability of LHCP signals and RHCP signals, respectively, having different directions of rotation of the circular polarization. The monopole 7, structured as a rod antenna 32, has an interruption point 5 connected with a reactive element 8, to configure its vertical diagram.

For the reception of geostationary satellites, in particular, whose signals come in at a comparatively low elevation in northern latitudes, it is provided that the one essentially perpendicular monopole 7 contains at least one interruption point 5, which is connected, i.e. bridged with at least one reactive element 8, to configure the vertical diagram. In this manner, the vertical diagram can advantageously be adapted to the requirements. The antenna connection point 2 is formed at the foot point of the monopole 7, at the connector to the matching network 33.

Figure 11:
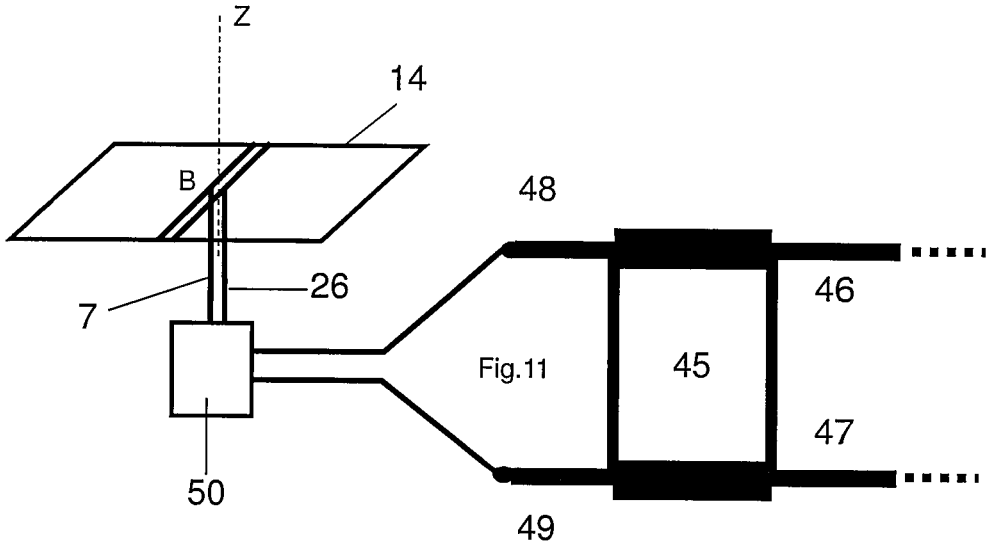
FIG. 11 discloses an antenna array similar to that shown in FIG. 10, but with implementation of the monopole according to the antenna array in FIG. 6, by means of a combination of the effects of the loop antenna as a roof capacitor and the two-wire line.

A similar antenna array is shown in FIG. 11, whereby the implementation of the monopole 7, however, takes place similar to the antenna array in FIG. 10, by means of the combination of the loop antenna 14 that acts as a roof capacitor, and the two-wire line 26. Using a combined matching circuit 50, not only the matching of the loop antenna 14 and the matching of the monopole 7, but also the setting of a common phase reference point B are brought about.

Figure 12:
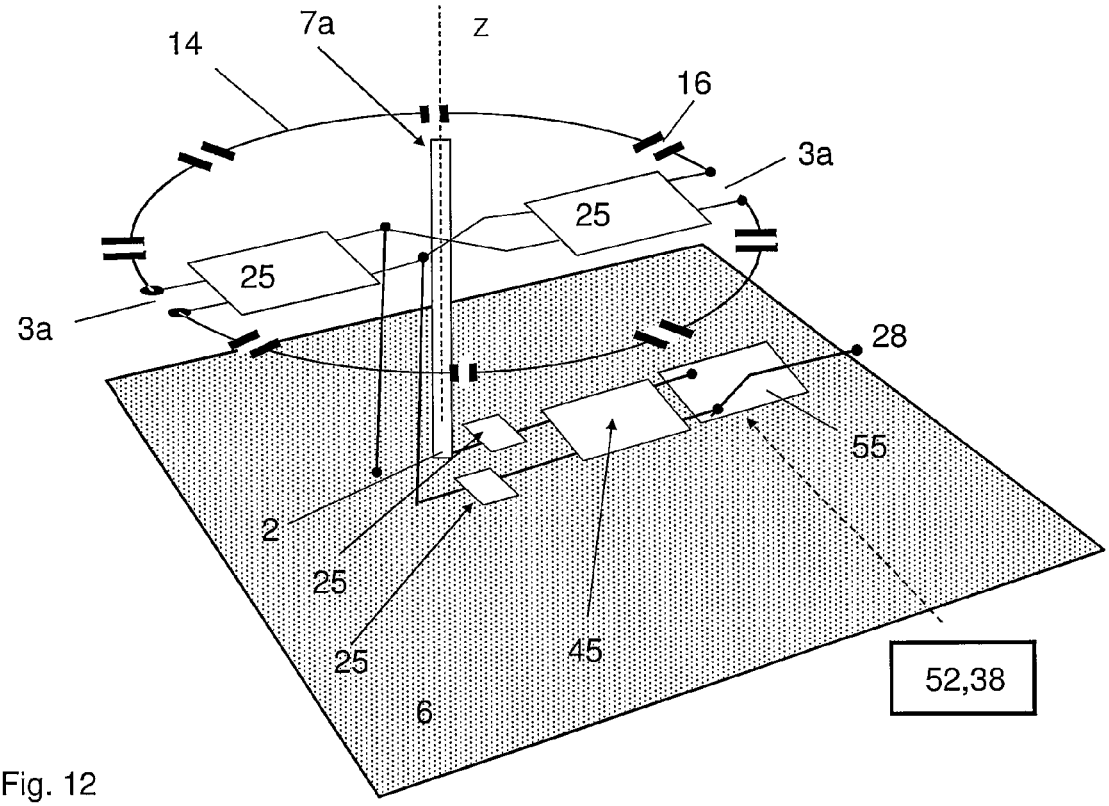
FIG. 12 discloses another embodiment showing an alternative uncoupling of RHCP signals and LHCP signals, respectively, for diversity technologies, controlled by a changeover switch situated in a radio reception module.

In another advantageous antenna array for alternative uncoupling of RHCP signals and LHCP signals, respectively, as shown in FIG. 12, a loop antenna 14—as in FIG. 6—is provided with two antenna connection points 3*a*, 3*b* and matching networks 25 connected with them and situated in the loop plane, which networks are implemented, for example, as λ/4 transformation lines. The outputs of the matching networks 25 are switched in parallel to add up. The reception signal is passed to an matching network 25 situated on the base surface 6, by way of the two-wire line 26, the output of which network is connected, in turn, to one of the two inputs of a signal combination circuit, particularly configured as a 90 degrees hybrid coupler 45. At the antenna connection point 2 at the foot point of the monopole 7*a*, situated in the center Z of the array and configured as a rod antenna, a matching network 25 is also connected, the output of which network feeds the other of the two inputs of the 90 degree hybrid coupler 45. An LHCP/RHCP changeover switch 55 connected with the outputs of the 90 degree hybrid coupler 45 makes satellite reception signals of the two rotation directions of the polarization available alternatively, at the connection point 28—controlled by a changeover control situated in a radio receiver module 52. In the case of control with a diversity control module 38 situated in an LHCP/RHCP radio module 52, the antenna array can advantageously be used also for polarization diversity, by means of switching between reception for LHCP waves and RHCP waves.

Figure 13:
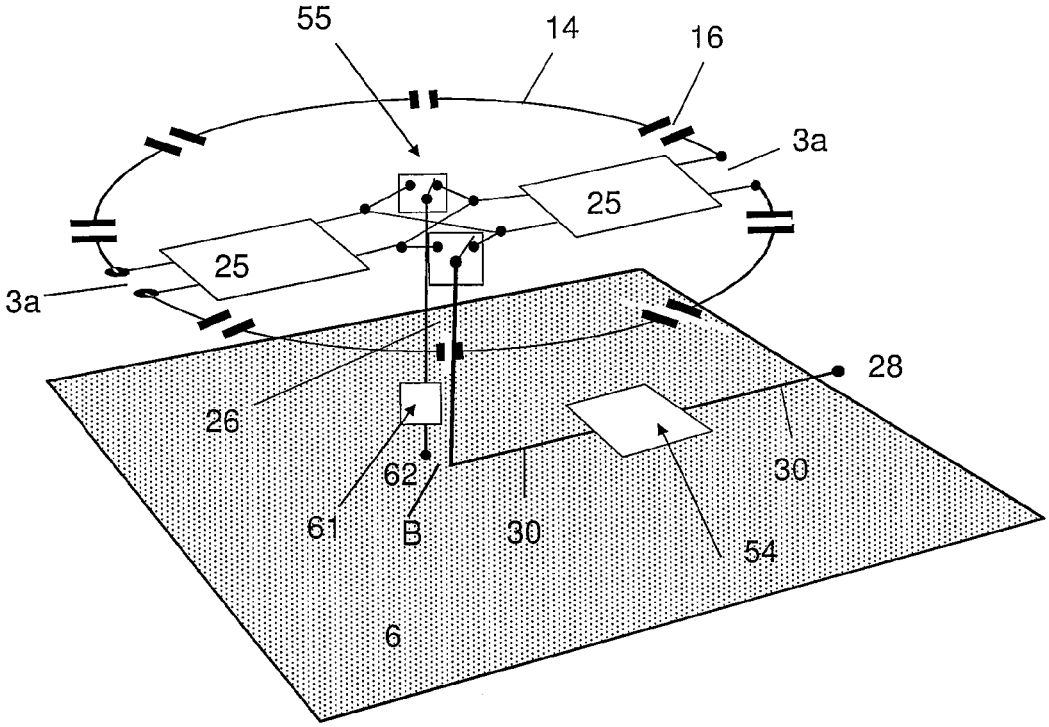
FIG. 13 discloses another embodiment showing diversity technologies, with LHCP/RHCP changeover switch as in FIG. 12, but, similar to the antenna in FIG. 8, without a separate monopole.

In another particularly efficient embodiment of such an antenna having a circularly polarized field with a reversible direction of rotation, in FIG. 13—similar to the antenna in FIG. 12—the separate monopole 7 is eliminated. The reception in the case of vertical polarization is brought about by the two-wire line 26. The phase difference that is required for superimposition of the reception signals of the loop antenna and of the monopole is brought about by the network 61. By means of inserting a suitably configured dipole network 61 into one of the strands of the vertical two-wire line 26, the difference of 90 degrees between the phases of the horizontal field component absorbed by the vertical two-wire line 26 with the loop antenna 14 as a roof capacitor 12 and by the loop antenna 14 is set in such a manner that their combination is present at the microstrip conductor 30 to the matching network 54 with this phase difference, and thus also at the connection point 28. As a result, the antenna receives a circularly polarized field. A circuit that links the reception signals of the loop antenna 14 at the output of the matching networks 25 from the horizontally polarized electrical field and the reception signals of the vertical two-wire line 26 from the vertically polarized electrical field comprises an LHCP/RHCP changeover switch 55 for changing the polarity of the reception voltage of the loop antenna 14. In this manner, the latter voltage can be added to the reception voltage from the vertically polarized electrical field, with a different sign, so that it is possible to switch between reception of the LHCP field and of the RHCP field by means of switching the LHCP/RHCP changeover switches 55. Controlled by a changeover control between LHCP and RHCP reception signals situated in the receiver, signals having differently rotated polarization of the satellite signals, from different transmission paths, are alternately available.

As has already been explained in connection with the antenna in FIG. 8—here again, a corresponding network 61 composed of reactive resistors can be interconnected with the strand of the vertical two-wire line 26 that is connected with ground. Using the network 61, the setting of the common mode to push-pull mode ratio on the vertical two-wire line 26 can be set. The reception voltages from the horizontal and the vertical electrical field components are superimposed in phase-differential manner, in accordance with the circular polarization. By means of setting the common mode to push-pull mode ratio on the vertical two-wire line 26, the ratio of the proportion of the vertically polarized field at a lower elevation of the main radiation direction can be set relative to the proportion of the horizontally polarized field at a higher elevation of the main radiation direction.

In another particularly advantageous embodiment of the invention, the antenna in the above embodiments is combined with another antenna element having an azimuthal all-around diagram, whose polarization is circular, and the phase of the circular polarization rotates with the azimuthal angle of the propagation vector—in other words with a complete azimuthal rotation about the angle $2\pi$. As already mentioned above, the antennas known from DE-A-4008505, DE-A-10163793, and EP 1 239 543 B1, respectively, from the state of the art, as well as other known antenna forms, fulfill this requirement. The method of effect of these antennas is essentially based on that the individual antenna parts are placed on planes that cross at a right angle and stand perpendicular to the base plane, and that the antenna parts of the different planes are interconnected offset in phase by 90 degrees, to produce the circular polarization. Even the effect of patch antennas can be represented in similar manner. Antenna elements 7*d* having an azimuthal all-around diagram, whose polarization is circular and whose phase of circular polarization rotates with the azimuthal angle of the propagation vector, and which are composed of two crossed antenna elements, will be referred to as "crossed antenna elements" in the following, for a simpler differentiation.

In the case of a combination of such a crossed antenna element 7*d*, in such a manner that its phase reference point B coincides with the antenna according to the invention as described above, and the signals of the two antennas are combined in amplitude-appropriate manner, by way of a controllable phase rotation element 39 and a summation network, a main direction of the radiation occurs, in advantageous manner, in the azimuthal directional diagram of the combined antenna array, which direction is dependent on the setting of the phase rotation element 39.

The method of effect of the superimposition of the signals will be explained using FIGS. 15 and 16. In FIG. 15*a*, the vertical directional characteristic of the LHCP-polarized electromagnetic field of an antenna according to the invention, as described above, is shown. The phase of this field is independent of the azimuthal angle and thus the phase for the azimuthal angles 0 degrees and 180 degrees, in each instance, is characterized with the same angle—0 degrees in the example. In comparison with this, the elevation directional diagram of another antenna element 7*d* described above is shown in FIG. 15*b*, of a type as produced by a crossed antenna element 7*d* as described above, whereby different phase values result for the azimuthal angles 0 degrees and 180 degrees, differing by 180 degrees, which are characterized with 0 degrees and 180 degrees in the example. Thus, in the case of phase-equal superimposition of the two signals, the antenna gain of the combined antenna array can be increased for the azimuthal angle 0 degrees and weakened for the azimuthal angle 180 degrees, and a zero point of the directional diagram can actually be set, in the case of a suitable setting of the amplitudes at a desired elevation angle, as shown in FIG. 16. If the two signals are superimposed offset relative to one another by the adjustable phase angle $\phi$, then—based on the phase change of the circular polarization of the crossed antenna element (7*d*) with the azimuthal angle of the propagation vector—the azimuthal directional diagram is obtained, while maintaining the elevation directional diagram about the same angle $\phi$, rotated in the one direction or the other. In this manner, the directional diagram of the combined antenna array can advantageously be tracked with its main direction pointing to the satellite, for example, in mobile operation, or an interference, for example, can be blocked out, in targeted manner, by means of assigning a direction to the zero point of the directional diagram. Particularly in the case of satellite reception in vehicles, in this way the signal/noise ratio can always be structured optimally, within the scope of dynamically tracked setting of the directional diagram.

Figure 17:
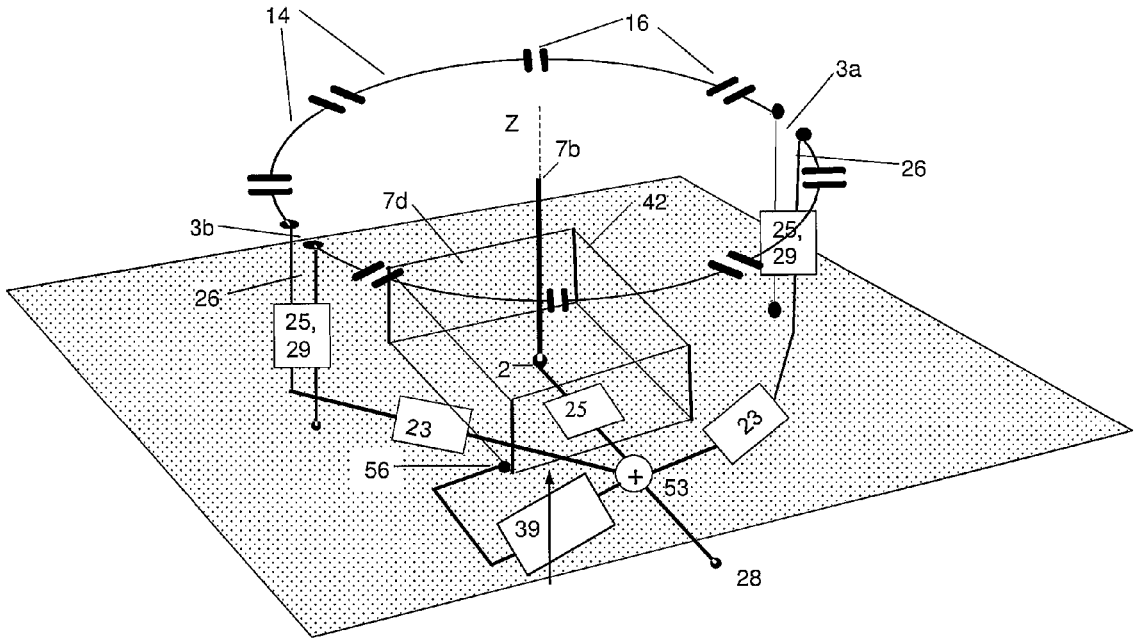
FIG. 17 discloses another embodiment comprising a loop antennae with two symmetrically disposed loop antenna connection points and monopole with construction space marked in the center Z for a crossed antenna element.

In FIG. 17, the combined antenna array according to the invention is shown with a crossed antenna element 7*b* indicated by the construction space 42, as it is shown, for example, in EP 1 239 543 B1, there in FIG. 10*a*. In this connection, the vertical antenna conductor 20 indicated there is structured in equivalent manner here in FIG. 17, as a vertical monopole 7*a* in the center Z, and is uncoupled from the connection point 56 of the crossed antenna element 49 because of the symmetry conditions. The latter is connected with the summation network 53 by way of the controllable phase rotation element 39, in which network the signals of the loop antenna 14, of the vertical monopole 7*a*, and of the crossed antenna element 49 are combined, with the suitable weighting, in each instance, to form the reception signal of the combined antenna array. In equivalent manner, an antenna of the type as described in DE-A-4008505, or a patch antenna having the vertical monopole 7*a* in the center Z, as well as an array of dipoles crossed parallel above the ground surface can be combined.

Figure 25:
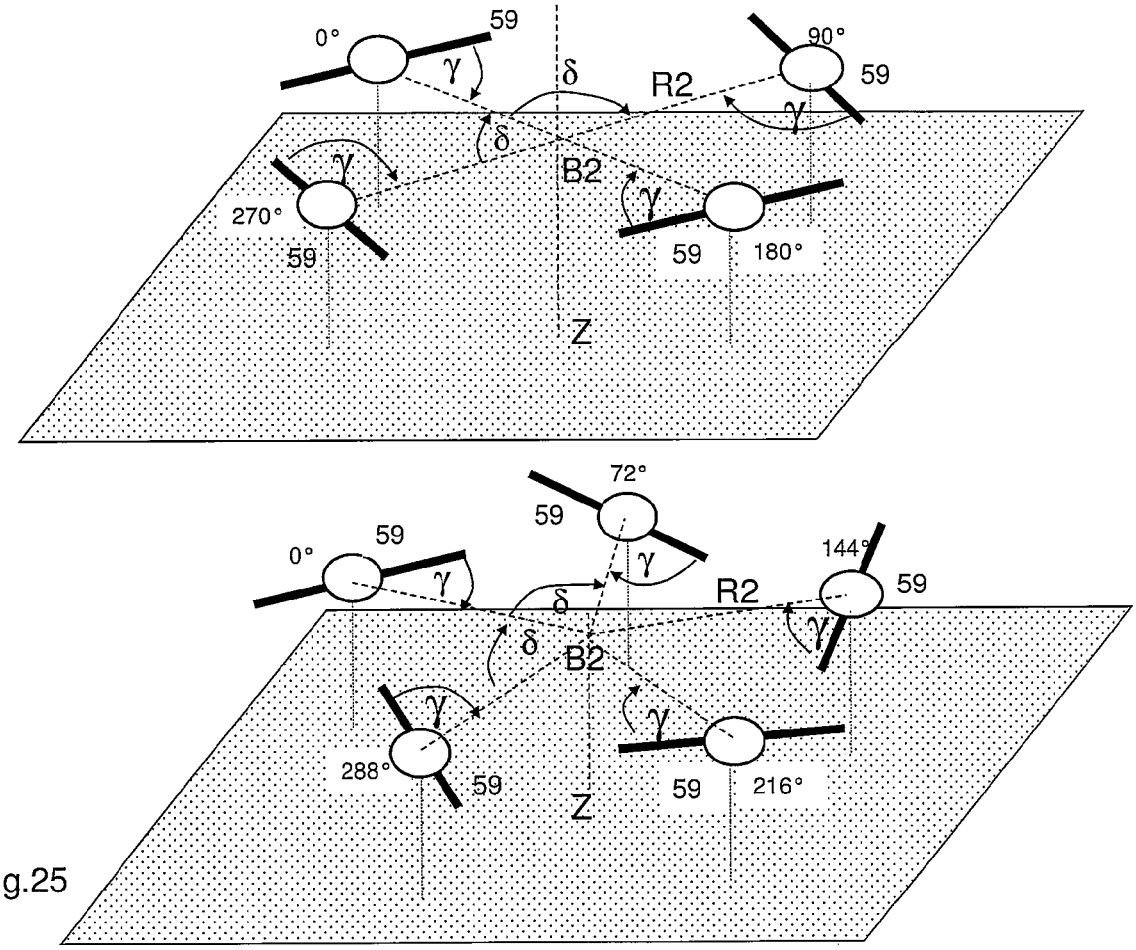
FIG. 25 discloses a perspective view of a circular group antenna element.

All arrays of n equal horizontal antenna element elements 59 can be used for this, if they are disposed in such a manner that their centers produce the corners of an equilateral polygon, and if rotation of the array about the z axis, by an angle of 360 degrees/n, reproduces the structure in itself, and if the feed of antenna element elements that are adjacent in the direction of rotation, in each instance, differs in phase by 360 degrees/n, in each instance. In FIG. 25, such arrays are shown for the example of four and five antenna element elements, in each instance. with n equal horizontally polarized antenna element elements 59 disposed with rotation symmetry about the center Z, whose feed differs in phase by 360 degrees/n, in each instance, from antenna element elements adjacent in the direction of rotation. FIG. 25 top: n=4. FIG. 25 bottom: n=5.

In a particularly advantageous further development of the invention, in place of an antenna element of the "crossed antenna element" type as described, a new type of additional antenna element 7*c* according to the invention, with circular polarization and an azimuthal all-around radiation diagram, the phase of which rotates with the azimuthal angle of the propagation vector, referred to in the following as a ring line antenna element 7*c*, for differentiation, is used. In FIG. 15(*b*), the vertical diagram of such an antenna according to the invention is shown as an example.

According to one embodiment of the invention, the ring line antenna element 7*c* is configured as a polygonal or circular closed ring line disposed with rotation symmetry about the center Z, running in a horizontal plane at the height h1 above the conductive base surface 6.

Figure 18:
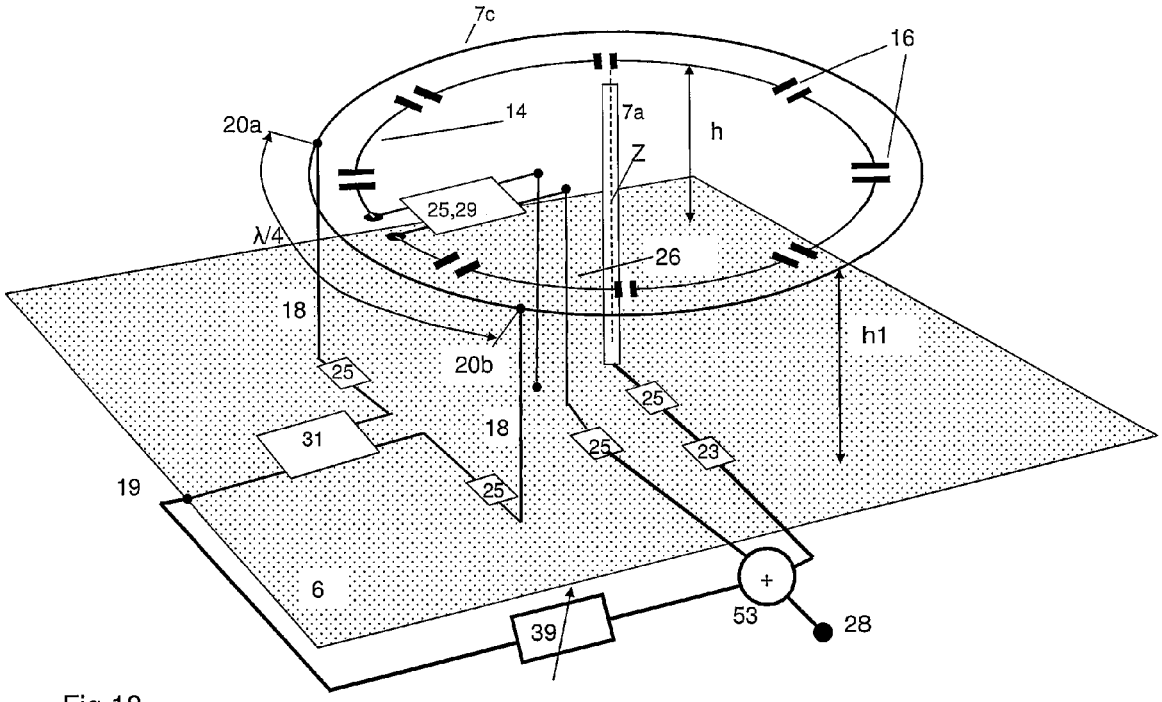
FIG. 18 discloses a schematic diagram of a perspective view of an antenna as shown in FIG. 17, having a centrally affixed crossed antenna element with a new type of ring line antenna element for producing a circularly polarized field with an azimuthally dependent phase.

According to one embodiment of the invention, the ring line is fed in such a manner that the current distribution of a running line wave occurs on it, the phase difference of which wave over a rotation amounts to precisely $2\pi$; thus the extended length of the ring line corresponds to the wavelength $\lambda$ that occurs on the ring line. The radiation contributions of the horizontally polarized individual line sections are superimposed in the far field, in such a manner that the desired radiation with circular polarization and the required phase dependence on the azimuthal propagation direction and the essentially omnidirectional azimuthal directional characteristic occur. In the case of a circular configuration of the ring line, its horizontal expanse is therefore $D=\lambda/\pi$. In the case of a ring line as shown in FIG. 18, the wavelength $\lambda$ on the ring line is equal to the free space wavelength $\lambda_0$. To reduce the diameter D, the wavelength $\lambda$ on the ring line can take place by increasing the line inductance or/and the line capacitance relative to the conductive base surface 6. This can take place in known manner, for example preferably by means of introduction of concentrated inductive elements into the line structure, or, for example, by means of a meander-shaped structure of the ring conductor.

FIG. 18 discloses a schematic diagram of a perspective view of an antenna as shown in FIG. 17, having a centrally affixed crossed antenna element with a new type of ring line antenna element for producing a circularly polarized field with an azimuthally dependent phase of feed at ring line feed points 20*a*, 20*b* spaced apart from one another by $\lambda/4$, of signals that differ in phase by 90, to produce a rotating wave having a wavelength over the circumference of the line.

This combined antenna array, consisting of the loop antenna 14 and the monopole 7*a* combined with it at a phase difference, to produce the circularly polarized radiation field with azimuthally independent phasing and a circular ring line antenna element 7*c* disposed concentrically, with the center Z, having a ring line connection point 19 for superimposition of its circularly polarized radiation field, but with azimuthally dependent phasing and for control of the azimuthal main direction by way of the controllable phase rotation element 39. The phase emphasis of the ring line antenna element 7*c* lies in the center Z of the antenna array, as a consequence of the phase distribution on the rotation-symmetrical ring line structure described, and thus coincides with the phase reference point B of the loop antenna 14 and that of the monopole 7*a*, as described—independent of the position of the controllable phase rotation element 39. Production of the continuous line wave on the ring line antenna element 7*c* takes place, proceeding from the ring line connection point 19, by way of the power splitter and phase shifter network 31, at whose outputs signals offset in phase from one another by 90 degrees are applied, which signals are connected, by way of an matching network 25, in each instance, by way of the feed lines 18, to ring line feed points 22*a* and 22*b* along the ring line structure, which are spaced apart from one another by $\lambda/4$. The particular advantage is connected with a ring line antenna element 7*c* of this type that it is configured concentric to the loop antenna 14 and with a greater diameter in comparison with it. A crosswise dimension usual for the loop antenna 14 can be configured within broad limits, but is generally smaller than $\lambda/4$ and can therefore be structured within the ring line antenna element 7*c* having the diameter $\lambda/\pi$. This allows advantageously generous configurability of the vertical monopole 7*b* or monopole system, respectively, situated in the center Z, as in FIGS. 3, 4, and 5, for example. Because of the geometrically required radiation uncoupling between the loop antenna 14 and the ring line antenna element 7*c* that surrounds it, the diameters of the two antenna elements can be configured, within broad limits, independent of one another, in the interests of the configuration of their vertical directional diagrams and the resulting vertical directional diagram of the antenna array at the antenna connector 28. Likewise, the distance h of the plane of the loop antenna 14 from the conductive base surface 6 can be selected to be different from the distance h1 between the plane of the ring line antenna element 7*c* and the conductive base surface 6, although it is particularly efficient for production if both antenna elements are imprinted onto the same planar carrier, for example in printed form. In FIG. 16(*a*), the vertical diagram, and in FIG. 16(*b*), the horizontal diagram of such an antenna according to the invention are shown as examples. For the example of a loop antenna 14 having a square shape, with a central, short vertical monopole, in combination with a ring line antenna element also having a square shape, in the frequency range about 2.3 GHz, an edge length of about 3 cm and a height h of 13 mm for the loop antenna 14, and an edge length of about 3.4 cm, which corresponds to about ¼ of the wavelength, and a height h of 10 mm for the square-shaped ring line antenna element have proven to be advantageous for implementing not only the directional diagram according to FIGS. 16A and 16B.

The loop antenna 14 is connected with the summation network 53 for forming the circularly polarized radiation, with azimuthal independence of the phase, by way of the two-wire line 26 that is at high ohms for common mode currents, by way of an matching network 25, and the monopole 7*a* is connected with it by way of an matching network 25 and by way of the phase shifter network 23. Likewise, the ring line connection point 19 is connected with the summation network 53 by way of the controllable phase rotation element 39, and the signals are superimposed on the other signals there, with the suitable weighting to produce the desired vertical directional diagram of the antenna array with an adjustable azimuthal main direction at the antenna connection 28.

Figure 19:
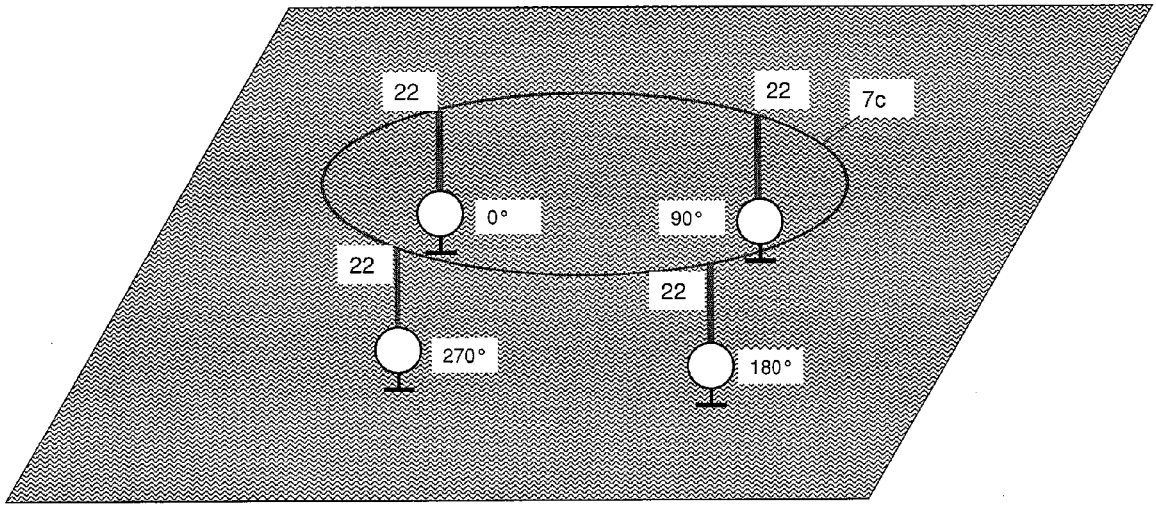
FIG. 19 discloses a perspective view of a ring line antenna element.

FIG. 19 discloses a perspective view of a ring line antenna element 7*c*, but fed by way of four feed points 22 offset by $\lambda/4$, in each instance, along the ring line, by signals offset in phase by 90°, in each instance. The feed sources can be obtained in known manner, by means of power splitting and 90° hybrid couplers 45.

This design is to complete the azimuthal symmetry wherein the feed sources can be obtained in known manner, by means of power splitting and 90 degree hybrid couplers 45.

Figure 20:
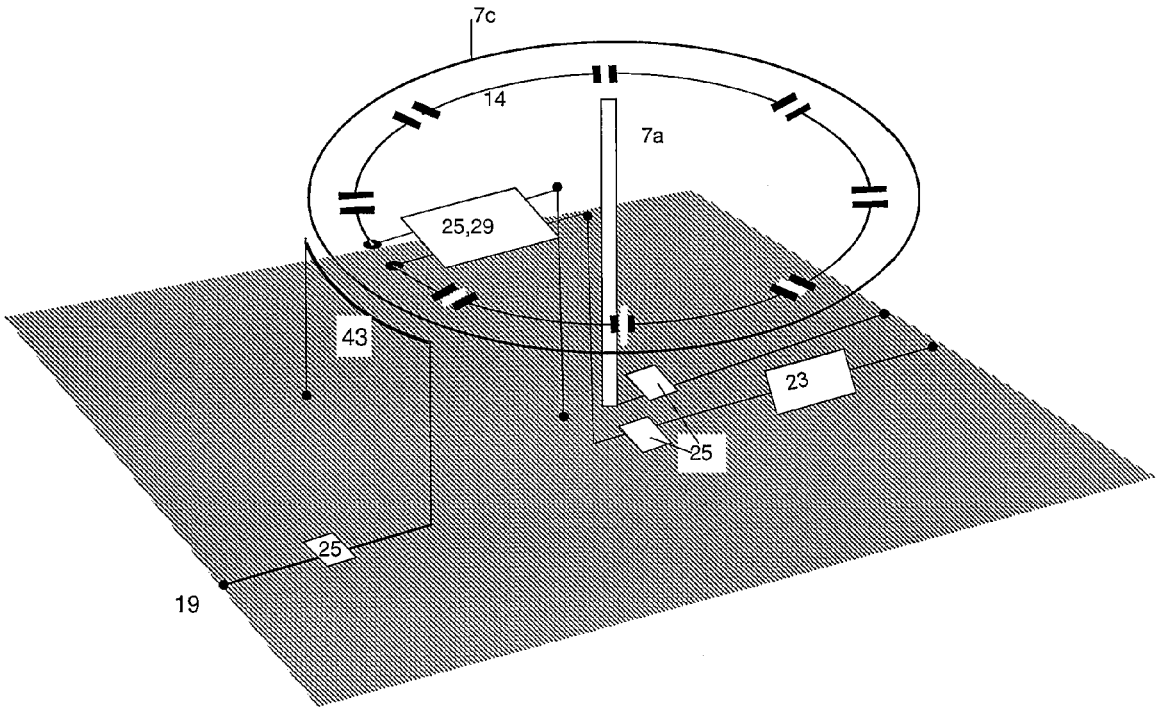
FIG. 20 discloses an antenna as in FIG. 18, but for production of the continuous line wave with a λ/4 there is a coupling conductor conducted at an advantageous distance—with reference to the line wave resistance—parallel to the ring line antenna element.

In an advantageous embodiment of the invention, production of the continuous line wave on the ring line antenna element 7*c* takes place analogous to FIG. 18, but by means of the $\lambda/4$ coupling conductor 43 in FIG. 20. The latter is guided at an advantageous distance, with regard to the line wave resistance, over an extended length of $\lambda/4$, parallel to the ring line antenna element 7*c*. For production, the $\lambda/4$ coupling conductor 43 can economically be applied to the same carrier as the ring line antenna element 7*c* and, if applicable, the loop antenna 14, in printed form.

Figure 21:
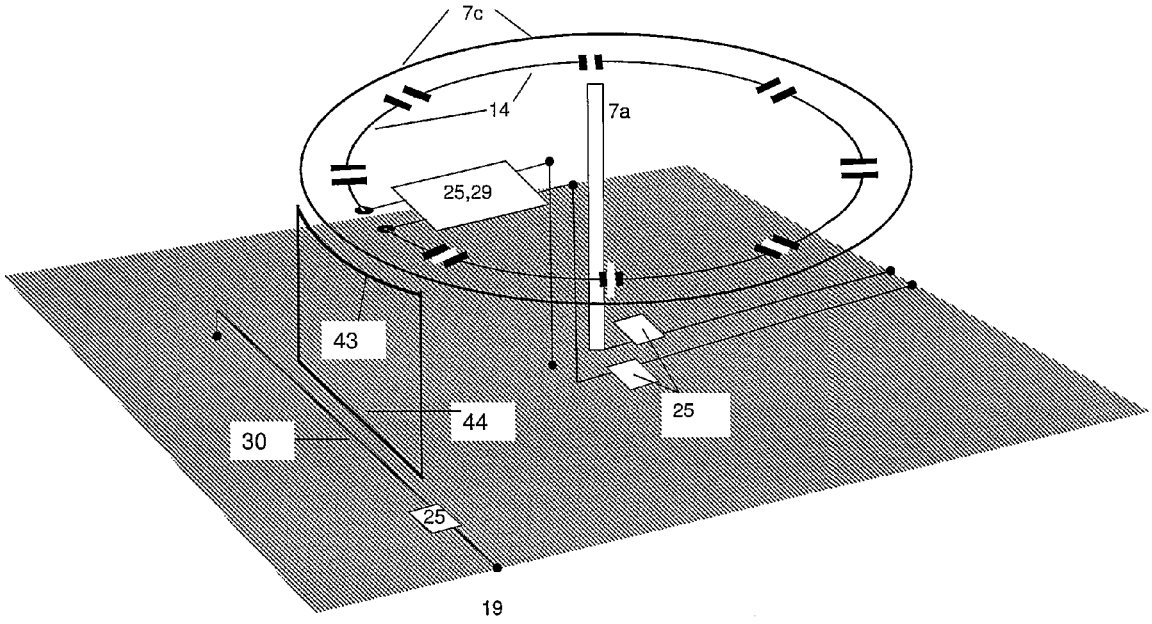
FIG. 21 discloses an antenna as in FIG. 20, but with a λ/4 directional coupler.

In another advantageous embodiment of the invention, production of the continuous line wave on the ring line antenna element 7*c* takes place analogous to FIG. 20, but by means of $\lambda/4$ directional coupler 44 in FIG. 21. A $\lambda/4$ coupling conductor 43 is guided parallel to a microstrip conductor 30, and, together with the λ/4 coupling conductor 43 coupled with the ring line antenna element 7*c*, forms the λ/4 directional coupler 44.

Figure 22:
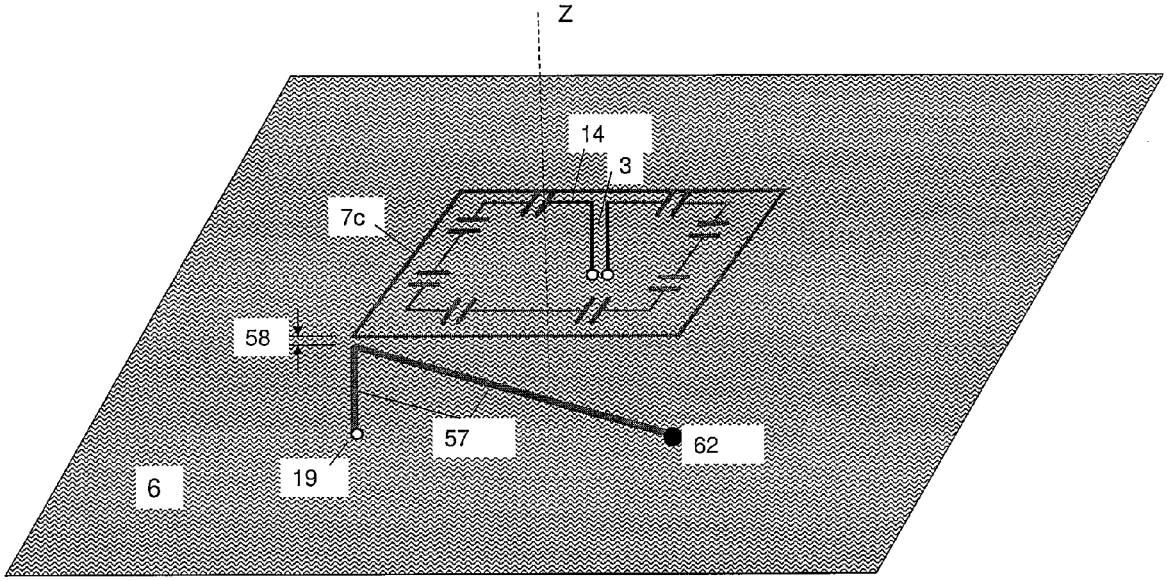
FIG. 22 discloses a perspective view of a loop antenna configured in square shape, and a ring line antenna element formed as a closed, square line ring having an edge length of λ/4.

In FIG. 22, the ring line antenna element 7*c* of an antenna is configured similar to FIG. 18, but as a closed, square line ring above the conductive base surface 6, having the edge length of λ/4 in a plane at the distance h1 above the conductive base surface 6. Coupling to the ring line antenna element 7*c* takes place in contact-free manner, by way of the λ/4 coupling conductor 57 configured in ramp shape, with the ring line connection point 19.

Likewise, the loop antenna 14 with its capacitors 6 is disposed, as a square conductor structure, within the ring line antenna element 7*c*, with the same center Z. The other antennas are not shown, for reasons of clarity. In FIG. 22, the ramp-shaped λ/4 coupling conductor 43 should be emphasized as a particularly advantageous form of contact-free coupling to the ring line antenna element 7*c*.

Proceeding from the ring line connection point 19 situated on the conductive base surface 6, a vertical feed line 18 leads all the way to one of the corners, except for a coupling distance 58, in order to meet with the base surface 6 there, essentially in accordance with a ramp function, below an adjacent corner, and to be connected with this surface in electrically conductive manner. This form of coupling is particularly advantageous for efficient production, since because of the square structure of the ring line antenna element 7*c*, the ramp-shaped 214 coupling conductor 43 can be configured on a planar carrier. By means of setting a suitable coupling distance 58, impedance matching at the ring line connection point 19 can furthermore be brought about in advantageous manner.

Figure 23:
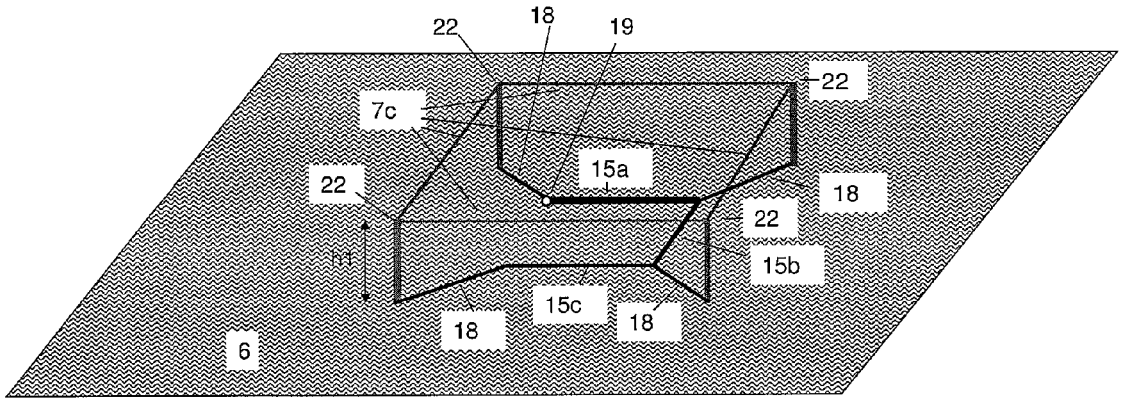
FIG. 23 discloses a perspective view of another embodiment with a square ring line antenna element 7*c* as in FIG. 22.

In FIG. 23, the ring line antenna element 7*c* is also configured to be square, as in FIG. 22, but is fed at its corners, in each instance, by way of a feed line 18, which runs over an equal length, as a microstrip conductor 30, on the conductive base surface 6, in each instance, and contains a vertical conductor of equal length, in each instance. The other antennas are not shown, for reasons of clarity. The feed line 18—proceeding from the ring line connection point 19—are connected with a power distribution network that consists of microstrip conductors 30 (15*a*, 15*b*, 15*c*) switched in a chain and having a length of λ/4. The wave resistances of the microstrip conductors 30—proceeding from a low wave resistance at the ring line connection point 19—at which one of the feed lines 18 is directly connected—are stepped up in such a manner that the signals fed into the ring line antenna element 7*c* at the corners possess the same power values and differ in phase by 90 degrees, in each instance, continuously trailing one another. The other antenna parts are also not shown, for reasons of clarity.

Figure 24:
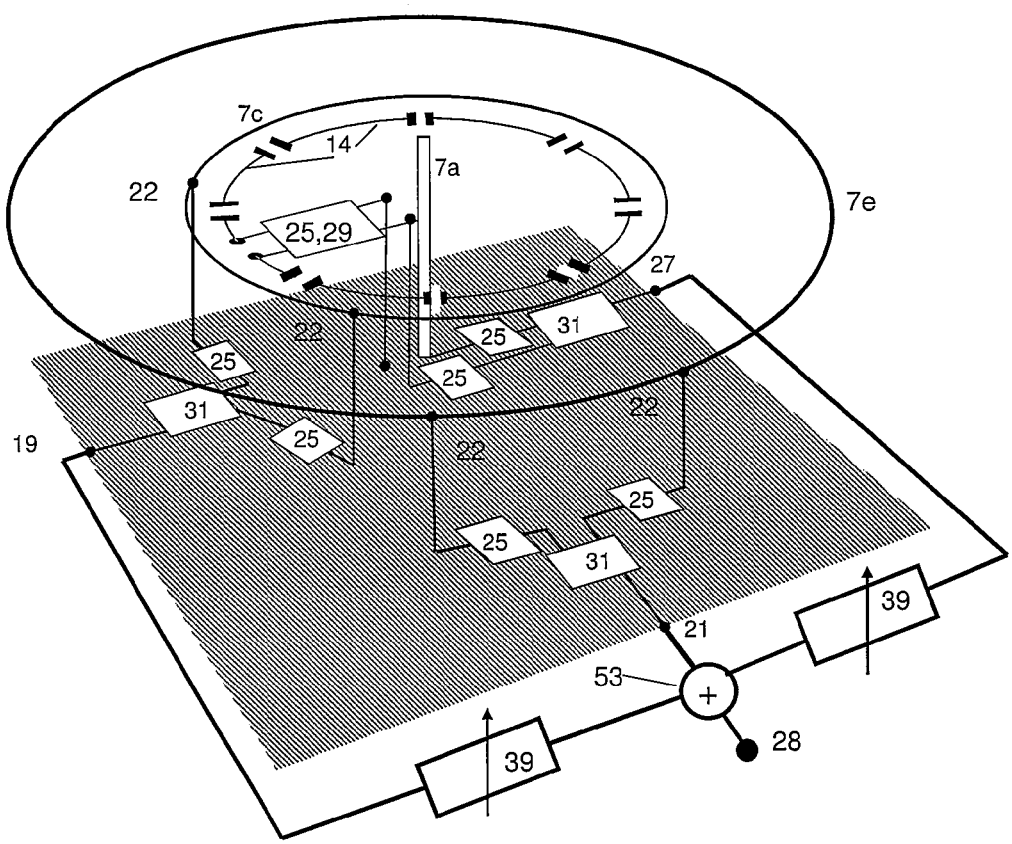
FIG. 24 discloses a perspective view of another embodiment.

In another embodiment as shown in FIG. 24, another antenna element in the form of an outer ring line antenna element 7*e* is present. This embodiment discloses a loop antenna 14, monopole 7*a*, ring line antenna element 7*c* and the additional outer ring line antenna element 7*d*, on which a continuous line wave of two wavelengths is produced, to raise the emission gain by increasing the emission bundling.

In contrast to the ring line antenna element 7*c*, the circumference of which precisely corresponds to a wavelength λ—in other words a full period—the circumference of the outer ring line antenna element 7*e* is selected to be two wavelengths λ, so that in the case of excitation by signals displaced in phase by 90 degrees relative to one another, at ring line feed points 22 along the outer ring line structure, spaced apart from one another by λ/4, a continuous line wave occurs on the ring line antenna element 7*d*. This feed occurs, in the example in FIG. 24, in the case of both ring lines, in similar manner, by way of the matching networks 25 and the power splitter and phase shifter network 31. The connection point 21 of the outer ring line antenna element 7*e* is also connected with the summation network 53, so that the effects of the radiation of the outer ring line antenna element 7*e* occur as a function of the weighting at the antenna connection 28. The signals at the loop antenna/monopole connection point 27, at the ring line connection point 19, and at the connection point 21 of the outer ring line antenna element 7*e*, are combined in weighted manner in the summation network 53, by way of controllable phase rotation elements 39, so that an increased antenna gain is achieved at the antenna connection 28, in the azimuthal main direction that is set. Because of the greater diameter of the outer ring line antenna element 7*e*, its contribution has a more sharply bundling effect than that of the circularly polarized ring line 7*c*. Although the polarization is no longer purely circular by adding the outer ring line antenna element 7*e*, the emission gain for certain situations can be increased by means of this measure, because of the overall sharper bundling.

Figure 26:
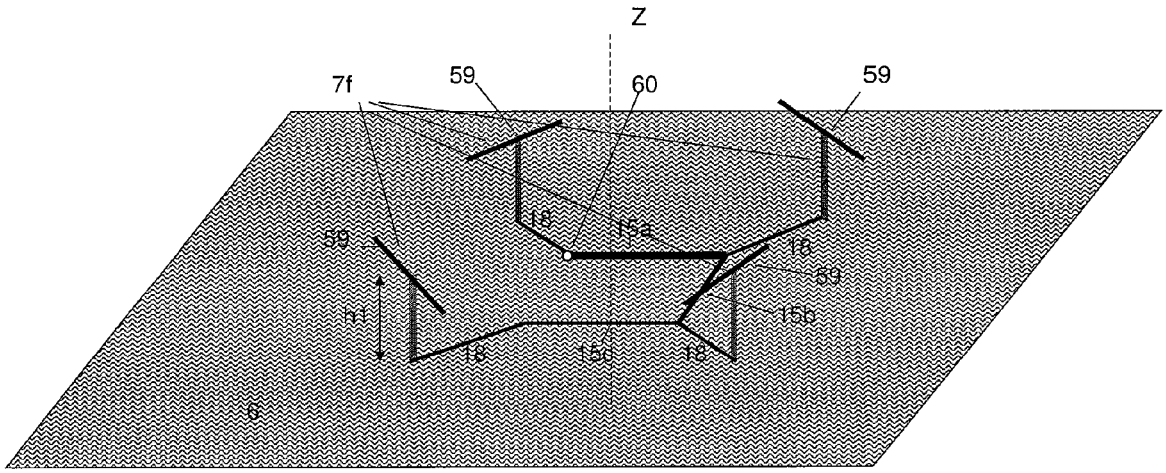
FIG. 26 shows a perspective view of another embodiment.

FIG. 26 shows a perspective view of a circular group antenna element 7*f* according to an array as in FIG. 25, with horizontally polarized antenna element elements 59 disposed at the corner points of a square having the center Z, with feed lines 18 and power splitter and phase shifter network composed of microstrip conductors 30 having a length of λ/4, with the partial pieces 15*a*, 15*b*, 15*c*.

With this design, a circular group antenna element 7*f* of the type described in FIG. 25 is shown. This consists of multiple horizontally polarized antenna element elements 59 disposed in a plane parallel to the conductive base surface 6 and at a distance from it, and azimuthally about the center Z, with rotation symmetry, on a circle K. By way of feed lines 18 with phase shifter network, a common circular group antenna element connection point 60 is created. In the case of reciprocal operation of the antenna, excitation of the circular group antenna element 7*f* is brought about in such a manner that each antenna element element 59 is excited with a current having the same amplitude, but in terms of phase, in such a manner that the amount of the current phase is selected to be equal to the azimuth angle Φ of the azimuthal position of the antenna element element 59, proceeding from an azimuthal reference line, so that the current phase rises or falls with an increasing azimuth angle Φ. For this purpose, the horizontally polarized antenna element elements 59 are disposed at the corner points of a square having the center Z, and are oriented perpendicular to the connection lines between the corner point in question and the center Z, in each instance. The horizontally polarized antenna element elements 59 are connected with the connectors of a power splitter and phase shifter network by way of a feed line 18 of equal length, in each instance. This network is configured from microstrip conductors 30 having a length of λ/4, interconnected in a chain on the conductive base surface 6, and having the partial pieces 15*a*, 15*b*, 15*c*, whose wave resistances—proceeding from a low wave resistance at the circular group antenna element connection point 60—to which one of the feed lines 18 is directly connected—are stepped up in such a manner that the signals fed into the antenna element elements 59 at the corners possess the same power values and differ in phase by 90°, in each instance, continuously trailing one another.

Accordingly, while a few embodiments of the present invention have been shown and described, it is to be understood that many changes and modifications may be made thereunto without departing from the spirit and scope of the invention as defined in the appended claims.

What is claimed is:

1. An antenna for reception of satellite radio signals emitted circularly in the direction of rotation of polarization comprising:

a) a conductive base surface;

b) an antenna connection point;

c) an additional element connection point;

d) at least one antenna output connector;

e) at least two antenna elements comprising:

i) at least one antenna element formed as a loop antenna which comprises a conductor loop disposed substantially parallel but spaced apart from said base surface, said loop antenna comprising a plurality of interruptions spaced apart from each other and a plurality of capacitors, wherein at least one interruption is bridged by at least one capacitor disposed along said conductor loop, wherein said at least one loop antenna connection point is coupled to at least one interruption of said loop antenna wherein said connection point is configured to feed a ring current into said loop antenna;

ii) at least one additional antenna element linearly polarized in a spatial direction and coupled to said additional antenna element connection point;

f) a plurality of networks comprising a matching network and a phase shifter network configured to connect said at least two antenna elements to said at least one antenna output connector wherein said additional element connection point and said at least one loop antenna are coupled to each other by said plurality of networks, wherein in reciprocal operation of the antenna, the radiation fields of said loop antenna and of said at least one additional antenna element are superimposed with different phases in a far field of the antenna;

wherein said at least one additional antenna element has a polarization orientated substantially perpendicular to the polarization of said loop antenna and an essentially orthogonal phase in the far field.

2. The antenna according to claim 1, wherein said plurality of capacitors are selected on said loop to maintain an azimuthally constant current application on said loop antenna, wherein said capacitors are configured together with the conductors to provide resonance on the loop.

3. The antenna according to claim 1, wherein said loop antenna is configured so that during reciprocal operation of said antenna, the radiation fields of said loop antenna and of the at least one additional antenna element antenna are superimposed on the far field of the antenna, for production of a radiation with circular polarization with substantially a same amplitude in an angle range between 30 degrees and 60 degrees and a phase difference of 90 degrees.

4. The antenna according to of claim 1, wherein said loop antenna connection point is formed by an interruption of said antenna loop, wherein said loop antenna is formed with rotation symmetry about a center axis z, on a plane, wherein said at least one additional antenna element is structured as an electrically short substantially vertical monopole, that passes through said center axis (z) of said loop antenna above the conductive base surface, wherein said additional element connection point of said monopole, as well as said loop antenna connection point of said loop antenna are connected with said antenna output connector via said matching and phase shifter network.

5. The antenna according to claim 1, wherein said loop antenna is disposed at a distance of a height h, from said electrically conductive base surface and wherein said additional antenna element is disposed above said electrically conductive base surface of said loop antenna, wherein an elevation angle of a main radiation direction is set by way of a selection of distance of said height h and of the substantially horizontal expanse of said loop antenna, and by way of a ratio between a set of amplitudes between said loop antenna and said additional antenna element.

6. The antenna according to claim 1, wherein said matching and phase shifter network are configured such that said loop antenna and said additional antenna element are offset in orientation by 90 degrees.

7. The antenna according to claim 1, further comprising a summation network wherein said matching and phase shifter network and said summation network are configured such that when the antenna acts as a transmission antenna, said first and second antenna element antennas comprising said loop antenna, and said monopole antenna are superimposed on one another, accordingly to influence a vertical directional diagram.

8. The antenna according to claim 1, further comprising a two wire line, wherein said at least one loop antenna connection point of said loop antenna is connected with said antenna output connector, wherein said two wire line is conducted between a plane of said conductor loop of said loop antenna and said electrically conductive base surface wherein said two wire line comprises:

a) said matching network;

b) a balance-unbalance element;

c) a summation network disposed on said conductive base surface wherein a desired phase ratio is set by way of a selection of a length of said two wire line, and said phase shifter network.

9. The antenna according to claim 1, wherein said additional antenna element which is orientated perpendicular to a plane of said loop antenna is formed from a plurality of monopoles disposed with rotation symmetry relative to a center axis (z) of said loop antenna wherein said loop antenna and said monopoles are connected with one another at their lower end by way of lines, in a center axis (z) to form an antenna element connection point.

10. The antenna according to claim 1, further comprising a balance-unbalance network, wherein said antenna connection point comprises a plurality of antenna connection points comprising two sets of antenna connection points that are disposed at substantially equal distances from each other, wherein said antenna connection points are connected with a second plurality of networks comprising said balance-unbalance and adaption networks whose outputs are switched in parallel by way of at least one phase shifter network and are connected by said two-wire line.

11. The antenna according to claim 1, wherein said additional antenna element comprises a plurality of conductor parts, wherein said conductor parts are structured to be symmetrical with a plane of symmetry.

12. The antenna according to claim 1, wherein said conductor parts of said loop antenna are conductively coupled together with conductor parts of said monopole, to form a rotation-symmetrical roof capacitor, wherein said roof capacitor is structured with substantial rotation symmetry with reference to a plane of symmetry SE.

13. The antenna according to claim 12, wherein the feed of said loop antenna is formed by said monopole with said roof capacitor, and wherein both antennas are thus fed in common by the additional element connection point, whereby said loop antenna is rotated azimuthally relative to the roof capacitor, about said center axis Z, so that different azimuthal angle distances $\alpha$ and $\beta$ result in the left direction of rotation and the right direction of rotation, between the substantially horizontal arms of said roof capacitor and the nearest interruption point, in each instance, with the capacitor introduced there on the loop antenna.

14. The antenna according to claim 1, further comprising a two-wire line for feeding said loop antenna, said two wire line forming a substantially vertical monopole and wherein said loop antenna forms a roof capacitor of said monopole and wherein said antenna connection points are disposed symmetrically relative to one another, wherein a reception voltage of said additional antenna element at said additional element connection point is passed to said two wire line as a common mode at one output, wherein said antenna further comprises a power splitter and phase shifter network as a push pull mode of said two wire line at anther output of said matching network for amplitude appropriate and phase differential superimposition of the signals of said antenna output connector.

15. The antenna as in claim 1, wherein said loop antenna (14) is formed by four dipoles (21) disposed in a square having a center axis (z) lying substantially horizontally and connected at their ends by way of capacitors (16), the antenna further comprising:

a distribution network (10);

a plurality of feed lines (18) disposed centrally in a phase reference point (b), wherein said roof capacitor of said substantially vertical monopole (7*a*) is formed by a dipole system;

a sum formation element (34);

a difference formation element (35)

wherein a reception of said substantially horizontal and substantially vertical electrical field components is performed by said sum formation element (34) and said difference formation element (35), and wherein a phase-differential superimposition of said signals is given via said matching and phase shifter network (23) in said summation network (53).

16. The antenna according to claim 1, further comprising a two wire line, wherein one of the conductors of said two wire line is conductively connected with a conductive base surface at a ground connection point, the antenna further comprising:

a dipole network configured to weigh a reception of a substantially horizontally polarized and substantially vertically polarized electrical field, wherein said dipole network sets a common mode to push pull mode ratio on said two wire line;

at least one matching network; and wherein another of said two conductors is connected with said antenna output connector via said at least one matching network; and wherein a setting of phases required for producing a circular polarization is provided using said dipole network.

17. The antenna according to claim 1, wherein said antenna is structured as a multi-frequency range antenna wherein said antenna further comprises:

a) dipole networks positioned in place of discrete capacitors on said antenna, wherein said dipole networks comprise a circuit comprising a plurality of reactive elements that are introduced into interruption points of said loop antennas, and wherein said dipole networks comprise different reactive resistance values at different operating frequencies.

18. The antenna according to claim 1, wherein said loop antenna further comprises:

a common phase reference point (B), related to said transmission case, a connector for substantially vertical polarization and a connector for substantially horizontal polarization;

a hybrid coupler having a 90 degree positive or negative phase difference, respectively, a plurality of additional connectors comprising a LHCP connector and a RHCP connector, wherein said connectors allow separate availability of LHCP signals and RHCP signals, respectively having different directions of rotation of circular polarization, wherein said additional antenna element comprising a monopole is configured as a rod antenna having an interruption point, and a reactive element connected to said interruption point to configure its substantially vertical diagram.

19. The antenna according to claim 1, further comprising a common phase reference point B;

and a combined matching circuit, wherein said additional antenna element comprises a monopole, wherein said loop antenna acts as a roof capacitor, wherein said loop antenna and an adaption of said monopole and also said common phase reference point B are brought about by said combined matching circuit.

20. The antenna according to claim 19, further comprising:

a circular group line antenna element (7*f*), comprising a plurality of substantially horizontally polarized antenna element elements (59) disposed in a plane parallel to said conductive base surface (6) and at a distance from this plane, and with azimuthal rotation symmetry about the center Z, on a circle (K), wherein said base surface (6) comprises a common circular group antenna element connection point (60);

the antenna further comprising a power splitter and phase shifter network (31);

a plurality of feed lines (18) coupled to said power splitter and phase shifter network (31), and in the case of reciprocal operation of the antenna, excitation of said circular group antenna element (7*f*) occurs so that each antenna element element (59) is excited with a current having the same amplitude, but in terms of current phase, so that the amount of the current phase is selected to be equal to the azimuth angle (Φ) of the azimuthal position of the antenna element element (59) that proceeds from an azimuthal reference line, so that the current phase rises or falls with an increasing azimuth angle (Φ).

21. The antenna according to claim 20, wherein the substantially horizontally polarized antenna element elements (59) are disposed at the corner points of a square having the said center axis Z and are oriented perpendicular to the connecting lines between the corner point in question and the center axis Z, in each instance, and the substantially horizontally polarized antenna element elements (59) are connected with the connectors of a power splitter and phase shifter network (31) by way of a feed line (18) of equal length, in each instance, and the latter network comprising microstrip conductors (30) (15*a*, 15*b*, 15*c*) interconnected in a chain, formed on the conductive base surface (6), having a length of λ/4, whereby their wave resistance values—proceeding from a low wave resistance value at the circular group antenna element connection point (60)—to which one of the feed lines (18) is directly connected—is stepped up in such a manner that the signals fed into the antenna element elements (59) at the corners possess the same power and differ by 90 degrees in terms of phase, in each instance, continuously trailing one another.

22. The antenna according to claim 1, further comprising a 90 degree hybrid coupler, and a LHCP/RHCP changeover switch which are connected at said antenna output connector, wherein said coupler and said changeover switch are controlled by means of a changeover control situated in said radio receiver module so that a satellite reception signal of a set of two directions of rotation of polarization are alternately available for polarization diversity.

23. The antenna according to claim 16, wherein said dipole network has phases that are set for alternative availability of two directions of rotation of the circular polarization for polarization diversity, wherein the antenna further comprises a LHCP/RHCP changeover switch for changing a polarity of a reception voltage of said loop antenna for superimposition of the reception voltage from the substantially vertically polarized electrical field.

24. The antenna according to claim 1, further comprising:

a crossed antenna element;

a summation network wherein reception signals are passed to said summation network;

a controllable phase rotation element configured to pass reception signals to said summation network, wherein there are added additional reception signals in a weighted manner, to form a main direction in an azimuthal directional diagram, so that the azimuthal main direction is variably set by means of variable setting of said phase rotation element.

25. The antenna according to claim 24, wherein said crossed antenna element is formed as a flat antenna for mobile satellite communications.

26. The antenna according to claim 24, wherein said crossed antenna element is formed by a patch antenna for circular polarization.

27. The antenna according to claim 24, further comprising a ring line antenna element (7*c*) with circular polarization and azimuthally dependent phase, which is configured as a rotation-symmetrical polygonal or circular closed ring line disposed about the center axis Z, running in a substantially horizontal plane having the height h1 above said conductive base surface (6), and which is excited electrically so that the current distribution of a running line wave occurs on the ring line, the phase difference of which wave over one rotation amounts to precisely $2\pi$, and thus the extended length of the ring line corresponds to a line wavelength $\lambda$.

28. The antenna according to claim 27, wherein said ring line antenna element (7*c*) is configured to be circular, with its center point in said center axis Z, the antenna further comprising and at least two ring line feed points (22), to produce a continuous line wave on the ring line antenna element (7*c*), spaced apart from one another along the ring line structure by $\lambda/4$, at which points signals of equal size are fed in by way of feed lines (18) connected with the closed ring line, which signals are offset in phase by 90 degrees relative to one another.

29. The antenna according to claim 28, further comprising a power splitter and phase shifter network (31), which is connected on the one side with the ring line connection point (19), and on the other side the two signals of equal size, displaced from one another by 90 degrees in terms of phase, are available for feed into the ring line, and the ring line connection point (19) are passed to the summation network (53) by way of a controllable phase rotation element (39), and there, in weighted manner, are added to the other reception signals to form the main direction in the azimuthal directional diagram, so that the azimuthal main direction is variably set by means of variable setting of the phase rotation element (39).

30. The antenna as in claim 29, further comprising four ring line feed points (22) spaced apart from one another by $\lambda/4$, in each instance, to produce a continuous line wave on said ring line antenna element (7*c*), at which points signals of equal size are fed into the closed ring line, which signals are offset in phase by 90 degrees relative to one another, in each instance.

31. The antenna as in claim 29, further comprising a directional coupling conductor (43) configured to produce a continuous line wave on the ring line antenna element (7*c*), wherein said continuous line wave is guided parallel to the ring line antenna element (7*c*) over an extended length of $\lambda/4$, at an advantageous coupling distance with regard to the line wave resistance, and wherein said directional coupling conductor (43) is connected on the one side, by way of a feed line (18) and an matching network (25), with the ring line connection point (19), and on the other side, by way of a feed line (18), with the conductive base surface (6).

32. The antenna as in claim 31, however, aside from this first $\lambda/4$ coupling conductor (43), a second directional coupling conductor (44) is coupled to a microstrip conductor (30) that runs on the conductive base surface (6), by means of parallel guidance at a slight distance, and the second directional coupling conductor (44) is connected with the first directional coupling conductor (43) by way of feed lines (18), and the microstrip conductor 30 is connected with the ring line connection point (19).

33. The antenna as in claim 32, wherein said the loop antenna (14) is configured as a square loop with loop antenna connection point (3), and the ring line antenna element (7*c*) is configured as a closed square line ring having the edge length of $\lambda/4$ above said conductive base surface (6), at a distance h1 above said conductive base surface (6), and wherein the antenna further comprises:

a ramp-shaped directional coupling conductor (57) having an advantageous length of $\lambda/4$, to produce a continuous line wave on said ring line antenna element (7*c*) and for contact-free coupling to said ring line antenna element (7*c*), which, proceeding from the ring line connection point (19) situated on the conductive base surface (6), by way of a substantially vertical feed line (18), leads to one of the corners, except for a coupling distance (58), in order to meet with said base surface (6) from there, essentially according to a ramp function, approximately below an adjacent corner, and is electrically conducted with it by way of the ground connector (62).

34. The antenna as in claim 33, further comprising ring line feed points (22) which are formed at the corners, and these are connected, by way of feed line (18) of equal length, to a connector of a power distribution network, in each instance, which network, on the other hand, is connected with the ring line connection point (19), and the power distribution network consists of microstrip conductors (30) (15*a*, 15*b*, 15*c*) having a length of $\lambda/4$ interconnected in a chain and formed on the conductive base surface (6), whereby their wave resistance values—proceeding from a low wave resistance value at the ring line connection point(19)—at which one of the feed lines (18) is directly connected—are stepped up in such a manner that the signals fed into the ring line antenna element (7*c*) at the corners possess the same power and differ by 90 degrees in terms of phase, in each instance, continuously trailing one another.

35. The antenna according to claim 33, further comprising another antenna element in the form of an outer ring line antenna element (7*e*), the circumference of which corresponds to two wavelengths $\lambda$, so that in the case of excitation with signals offset from one another by 90 degrees in terms of phase, a continuous line wave occurs at ring line feed points (22) spaced apart from one another by $\lambda/4$, along the outer ring line structure, and that the gain of these signals, proceeding from the connection point (21) of the outer ring line, is given in similar manner as for feed of the ring line antenna element (7*c*), and the signals at the loop antenna/monopole connection point (27) at the ring line connection point (19) and at the connection point (21) of the outer ring line are combined in the summation network (53), by way of controllable phase rotation elements (39), in weighted manner, so that an increased antenna gain is achieved at the antenna output connector (28) in the azimuthal main direction that is set.

36. An antenna for reception of satellite radio signals emitted circularly in the direction of rotation of polarization comprising:

a) a conductive base surface;

b) an antenna connection point;

c) an additional element connection point;

d) at least one antenna output connector;

e) at least two antenna elements comprising:

i) at least one antenna element formed as a loop antenna which comprises a conductor loop disposed substantially parallel but spaced apart from said base surface, said loop antenna comprising at least one interruption and at least one capacitor, wherein said at least one interruption is bridged by said at least one capacitor disposed along said conductor loop, wherein said at least one loop antenna connection point is coupled to at least one interruption of said loop antenna wherein said connection point is configured to feed a ring current into said loop antenna;

ii) at least one additional antenna element linearly polarized in a spatial direction and coupled to said additional element connection point;

f) a plurality of networks comprising a matching network and a phase shifter network configured to connect said at least two antenna elements to said at least one antenna output connector wherein said additional element connection point and said at least one loop antenna are coupled to each other by said plurality of networks, wherein in reciprocal operation of the antenna, the radiation fields of said loop antenna and of said at least one additional antenna element are superimposed with different phases in a far field of the antenna;

wherein said at least one additional antenna element has a polarization orientated substantially perpendicular to the polarization of said loop antenna and an essentially orthogonal phase in the far field.

* * * * *